US010431444B2

(12) United States Patent
Bazargan et al.

(10) Patent No.: US 10,431,444 B2
(45) Date of Patent: Oct. 1, 2019

(54) SYSTEMS AND METHODS FOR AUTOMATED ANALYSIS OF OUTPUT IN SINGLE PARTICLE INDUCTIVELY COUPLED PLASMA MASS SPECTROMETRY AND SIMILAR DATA SETS

(71) Applicant: PerkinElmer Health Sciences, Inc., Waltham, MA (US)

(72) Inventors: Samad Bazargan, Richmond Hill (CA); Hamid Badiei, Woodbridge (CA)

(73) Assignee: PerkinElmer Health Sciences, Inc., Waltham, MA (US)

( * ) Notice: Subject to any disclaimer, the term of this patent is extended or adjusted under 35 U.S.C. 154(b) by 112 days.

(21) Appl. No.: 15/663,446

(22) Filed: Jul. 28, 2017

(65) Prior Publication Data

US 2017/0358438 A1 Dec. 14, 2017

Related U.S. Application Data

(63) Continuation of application No. 14/181,348, filed on Feb. 14, 2014, now Pat. No. 9,754,774.

(51) Int. Cl.
*H01J 49/10* (2006.01)
*H01J 49/00* (2006.01)

(52) U.S. Cl.
CPC ..... *H01J 49/105* (2013.01); *H01J 49/0036* (2013.01)

(58) Field of Classification Search
CPC ..... H01J 49/105; H01J 49/0036
See application file for complete search history.

(56) References Cited

U.S. PATENT DOCUMENTS

| | | | | |
|---|---|---|---|---|
| 6,140,638 | A | 10/2000 | Tanner et al. | |
| 6,627,912 | B2 | 9/2003 | Bandura et al. | |
| 6,972,408 | B1 | 12/2005 | Reilly | |
| 8,426,804 | B2 | 4/2013 | Badiei et al. | |
| 10,180,386 | B2 | 1/2019 | Bandura et al. | |
| 2001/0027382 | A1 | 10/2001 | Jarman et al. | |
| 2006/0255258 | A1 | 11/2006 | Wang et al. | |
| 2007/0110144 | A1* | 5/2007 | Teshima | G01N 21/274 375/224 |

(Continued)

FOREIGN PATENT DOCUMENTS

| | | | |
|---|---|---|---|
| JP | 2000152031 | A | 5/2000 |
| JP | 2007530924 | A | 11/2007 |

(Continued)

OTHER PUBLICATIONS

Agilent Technologies, Agilent 7500 ICP-MS ChemStation (G1834B) Operators Manual, 12 pages (2005).

(Continued)

*Primary Examiner* — Manuel L Barbee
(74) *Attorney, Agent, or Firm* — Banner & Witcoff, Ltd.

(57) ABSTRACT

The present disclosure provides methods and systems for automated analysis of spectrometry data corresponding to particles of a sample, such as large data sets obtained during single particle mode analysis of an inductively coupled plasma mass spectrometer (SP-ICP-MS). Techniques are presented herein that provide appropriate smoothing for rapid data processing without an accompanying reduction (or with an acceptably negligible reduction) in accuracy and/or precision.

26 Claims, 20 Drawing Sheets

(56) References Cited

U.S. PATENT DOCUMENTS

| | | | | |
|---|---|---|---|---|
| 2008/0296490 | A1 | 12/2008 | Hidalgo et al. | |
| 2011/0019187 | A1 | 1/2011 | Mizukami et al. | |
| 2012/0091331 | A1 | 4/2012 | Badiei et al. | |
| 2013/0038878 | A1* | 2/2013 | Muraki ..... | G01N 15/1459 356/436 |
| 2013/0119249 | A1 | 5/2013 | Niehuis | |
| 2013/0268212 | A1 | 10/2013 | Makarov et al. | |
| 2015/0235827 | A1 | 8/2015 | Bazargan et al. | |
| 2015/0235833 | A1 | 8/2015 | Bazargan et al. | |

FOREIGN PATENT DOCUMENTS

| | | | |
|---|---|---|---|
| JP | 2008515169 | A | 5/2008 |
| JP | 2013532886 | A | 8/2013 |
| JP | 2013231715 | A | 11/2013 |
| WO | WO-00/60493 | A2 | 10/2000 |
| WO | WO-2006/110848 | A2 | 10/2006 |
| WO | WO-2009/131175 | A1 | 10/2009 |
| WO | WO-2011/106768 | A1 | 9/2011 |
| WO | 2012125548 | A2 | 9/2012 |
| WO | 2013154425 | A1 | 10/2013 |
| WO | WO-2015/122920 | A1 | 8/2015 |
| WO | WO-2015/123555 | A1 | 8/2015 |

OTHER PUBLICATIONS

Borovinskaya, O. et al., A prototype of a new inductively coupled plasma time-of-flight mass spectrometer providing temporally resolved, multi-element detection of short signals generated by single particles and droplets, Journal of Analytical Atomic Spectrometry, 28:2:226-233, (2013).

Cornelis, G. and Hassellov, M., A signal deconvolution method to discriminate smaller nanoparticles in single particle ICP-MS, J. Anal. At. Spectrom., 29:134-144, (2014).

Gschwind, S. et al., Capabilities of inductively coupled plasma mass spectrometry for the detection of nonoparticles carried by monodisperse microdroplets, Journal of Analytical Atomic Spectrometry, 26:6:1166-1174, (2011).

Hineman, A. et al., Effect of dwell time on single particle inductively coupled plasma mass spectrometry data acquisition quality, Journal of Analytical Atomic Spectrometry, 29:7:1252-1257, (2014).

International Search Report for PCT/US2014/016588, dated Oct. 15, 2014, 4 pages.

International Search Report, PCT/US2015/015875, 4 pages (dated May 8, 2015).

Laborda, F. et al., Critical considerations for the determination of nanoparticle number concentrations, size and number size distributions by single particle ICP-MS, J. Anal. At. Spectrom, 28:1220-1232, (2013).

McCurdy, E. et al., The Measure of Confidence, Agilent ICP-MS Journal, issue 48, 8 pages (2011).

Mitrano, D. M. et al., Silver nanoparticle characterization using single particle ICP-MS (SP-ICP-MS) and asymmetrical flow field flow fractionation ICP-MS (AF4-ICP-MS), J. Anal. At. Spectrom., 27:1131-1142, (2012).

Olesik, J. and Gray, P., Considerations for measurement of individual nanoparticles or microparticles by ICP-MS: determination of the umber of particles and the analyte mass in each particle, J. Anal. At. Spectrom., DOI: 10.1039/C2JA30073G, (2012).

Pace, H. E. et al., Correction to Determining Transport Efficiency for the Purpose of Counting and Sizing Nanoparticles via Single Particle Inductively Coupled Plasma Mass Spectrometry, Anal. Chem., 84:4633-4633, (2012).

Pace, H. et al., Determining Transport Efficiency for the Purpose of Counting and Sizing Nanoparticles via Single Particle Inductively Coupled Plasma Mass Spectrometry, Analytical Chemistry, 83:24:9361-9369, (2011).

Shigeta, K. et al., Application of micro-droplet generator for an ICP-sector field mass spectrometer—optimization and analytical characterization, Journal of Analytical Atomic Spectrometry, 28:5:645-656, (2012).

Touriniemi, Jani, New single particle methods for detection and characterization of nanoparticles in environmental samples, http://hdl.handle.net/2077/33677, pp. 1-66, (2013).

Tuoriniemi, J. et al., Size Discrimination and Detection Capabilities of Single-Particle ICPMS for Environmental Analysis of Silver Nanoparticles, Anal. Chem., 84:3965-3972, (2012).

Written Opinion for PCT/US2014/016588, dated Oct. 15, 2014, 9 pages.

Written Opinion, PCT/US2015/015875, 8 pages (dated May 8, 2015).

* cited by examiner

620

| 1 | Pulse coun | 1st iteratior | 2nd iteratior | 3rd iteratior | 4th iteratior | 5th iteratior | 6th iteratior | 7th iteratior |
|---|---|---|---|---|---|---|---|---|
| 2 | 1 | 1 | 1 | 1 | 1 | 1 | 1 | 1 |
| 3 | 8 | 8 | 8 | 8 | 8 | | | |
| 4 | 34 | 34 | 34 | | | | | |
| 5 | 118 | 118 | | | | | | |
| 6 | 240.002 | | | | | | | |
| 7 | 214.002 | | | | | | | |
| 8 | 117 | 117 | | | | | | |
| 9 | 129.001 | | | | | | | |
| 10 | 124.001 | 124.001 | | | | | | |
| 11 | 96 | 96 | | | | | | |
| 12 | 35 | 35 | 35 | | | | | |
| 13 | 10 | 10 | 10 | 10 | 10 | | | |
| 14 | 6 | 6 | 6 | 6 | 6 | 6 | 6 | 6 |
| 15 | 1 | 1 | 1 | 1 | 1 | 1 | 1 | 1 |
| 16 | 2 | 2 | 2 | 2 | 2 | 2 | 2 | 2 |
| 17 | 1 | 1 | 1 | 1 | 1 | 1 | 1 | 1 |
| 18 | 0 | 0 | 0 | 0 | 0 | 0 | 0 | 0 |
| 19 | 2 | 2 | 2 | 2 | 2 | 2 | 2 | 2 |
| 20 | 3 | 3 | 3 | 3 | 3 | 3 | 3 | 3 |
| 21 | 3 | 3 | 3 | 3 | 3 | 3 | 3 | 3 |
| 22 | 2 | 2 | 2 | 2 | 2 | 2 | 2 | 2 |
| 23 | 2 | 2 | 2 | 2 | 2 | 2 | 2 | 2 |
| 24 | 5 | 5 | 5 | 5 | 5 | 5 | 5 | 5 |
| 25 | 3 | 3 | 3 | 3 | 3 | 3 | 3 | 3 |
| 26 | 4 | 4 | 4 | 4 | 4 | 4 | 4 | 4 |
| 27 | 23 | 23 | 23 | 23 | | | | |
| 28 | 47 | 47 | 47 | | | | | |
| 29 | 116 | 116 | | | | | | |
| 30 | 187.001 | | | | | | | |
| 31 | 257.002 | | | | | | | |
| 32 | 136.001 | | | | | | | |
| 33 | 75 | 75 | | | | | | |
| 34 | 23 | 23 | 23 | 23 | | | | |
| 35 | 13 | 13 | 13 | 13 | | | | |
| 36 | 10 | 10 | 10 | 10 | 10 | | | |
| 37 | 5 | 5 | 5 | 5 | 5 | 5 | 5 | 5 |
| 38 | 5 | 5 | 5 | 5 | 5 | 5 | 5 | 5 |
| 39 | 11 | 11 | 11 | 11 | | | | |
| 40 | 98 | 98 | | | | | | |
| 41 | 291.003 | | | | | | | |
| 42 | 202.001 | | | | | | | |
| 43 | 58 | 58 | 58 | | | | | |
| 44 | 18 | 18 | 18 | 18 | | | | |
| 45 | 4 | 4 | 4 | 4 | 4 | 4 | 4 | 4 |
| 46 | 1 | 1 | 1 | 1 | 1 | 1 | 1 | 1 |
| 47 | 6 | 6 | 6 | 6 | 6 | 6 | 6 | 6 |
| 48 | 3 | 3 | 3 | 3 | 3 | 3 | 3 | 3 |
| 49 | 3 | 3 | 3 | 3 | 3 | 3 | 3 | 3 |
| 50 | 1 | 1 | 1 | 1 | 1 | 1 | 1 | 1 |
| 51 | 2 | 2 | 2 | 2 | 2 | 2 | 2 | 2 |
| 52 | 2 | 2 | 2 | 2 | 2 | 2 | 2 | 2 |
| 53 | 2 | 2 | 2 | 2 | 2 | 2 | 2 | 2 |
| 54 | 4 | 4 | 4 | 4 | 4 | 4 | 4 | 4 |
| 55 | 1 | 1 | 1 | 1 | 1 | 1 | 1 | 1 |
| 56 | 24 | 24 | 24 | 24 | | | | |
| 57 | 163.001 | | | | | | | |
| 58 | 168.001 | | | | | | | |
| 59 | 71 | 71 | | | | | | |
| 60 | 85 | 85 | | | | | | |

640

| | | | | |
|---|---|---|---|---|
| Threshold for | | | | |
| 0th Iteration | Average | Stdev | Avg+3*Stdev | |
| | 12.43048 | 37.8508 | 125.9829 | |
| | | | | |
| 1th Iteration | Average | Stdev | Avg+3*Stdev | |
| | 6.786381 | 17.65409 | 59.74864 | |
| | | | | |
| 2nd Iteration | Average | Stdev | Avg+3*Stdev | |
| | 3.674169 | 6.968118 | 24.57852 | |
| | | | | |
| 3rd Iteration | Average | Stdev | Avg+3*Stdev | |
| | 2.557032 | 2.799432 | 10.95533 | |
| | | | | |
| 4th Iteration | Average | Stdev | Avg+3*Stdev | |
| | 2.24095 | 1.696602 | 7.330755 | |
| | | | | |
| 5th Iteration | Average | Stdev | Avg+3*Stdev | |
| | 2.16476 | 1.545149 | 6.800207 | |
| | | | | |
| 6th Iteration | Average | Stdev | Avg+3*Stdev | |
| | 2.15367 | 1.529431 | 6.741963 | |
| | | | | |
| 7th Iteration | Average | Stdev | Avg+3*Stdev | |
| | 2.15367 | 1.529431 | 6.741963 | Threshold stopped changing |
| | | | | |
| | | | | |
| | | | | |
| | | | | |
| Background: | 2.15499 | | | |
| Threshold for Peak del | 6.74196 | | | |

650

FIG. 6B

| | |
|---|---|
| Threshold = | 7.313147 |
| Background = | 2.430468 |
| | |
| Number of peaks detected = | 17 |

720

| | 722 A | B | C | 724 D | 726 E | 728 F |
|---|---|---|---|---|---|---|
| 1 | | | | | | |
| 2 | Pulse counts | | | 5pt avera | Peak | PeaksMax |
| 3 | 1 | | | | | |
| 4 | 8 | | | | | |
| 5 | 34 | | | 80.2004 | | |
| 6 | 118 | | | | | |
| 7 | 240.002 | | | | | |
| 8 | 214.002 | | | | | 214.002 |
| 9 | 117 | | | | | |
| 10 | 129.001 | | | 136.0008 | 1 | |
| 11 | 124.001 | | | | | |
| 12 | 96 | | | | | |
| 13 | 35 | | | | | |
| 14 | 10 | | | | | |
| 15 | 6 | | | 10.8 | | |
| 16 | 1 | | | | | |
| 17 | 2 | | | | | |
| 18 | 1 | | | | | |
| 19 | 0 | | | | | |
| 20 | 2 | | | 1.8 | | |
| 21 | 3 | | | | | |
| 22 | 3 | | | | | |
| 23 | 2 | | | | | |
| 24 | 2 | | | | | |
| 25 | 5 | | | 3.2 | | |
| 26 | 3 | | | | | |
| 27 | 4 | | | | | |
| 28 | 23 | | | | | |
| 29 | 47 | | | | | |
| 30 | 116 | | | 126.0006 | 1 | |
| 31 | 187.001 | | | | | |
| 32 | 257.002 | | | | | 257.002 |
| 33 | 136.001 | | | | | |
| 34 | 75 | | | | | |
| 35 | 23 | | | 51.4002 | | |
| 36 | 13 | | | | | |
| 37 | 10 | | | | | |
| 38 | 5 | | | | | |
| 39 | 5 | | | | | |
| 40 | 11 | | | 82.0006 | 1 | |
| 41 | 98 | | | | | |
| 42 | 291.003 | | | | | 291.003 |
| 43 | 202.001 | | | | | |
| 44 | 58 | | | | | |
| 45 | 18 | | | 56.6002 | | |

| | 722 A | B | C | 724 D | 726 E | 728 F |
|---|---|---|---|---|---|---|
| 46 | 4 | | | | | |
| 47 | 1 | | | | | |
| 48 | 6 | | | | | |
| 49 | 3 | | | | | |
| 50 | 3 | | | 3 | | |
| 51 | 1 | | | | | |
| 52 | 2 | | | | | |
| 53 | 2 | | | | | |
| 54 | 2 | | | | | |
| 55 | 4 | | | 6.6 | | |
| 56 | 1 | | | | | |
| 57 | 24 | | | | | |
| 58 | 163.001 | | | | | |
| 59 | 168.001 | | | | | 168.001 |
| 60 | 71 | | | 115.8004 | 1 | |
| 61 | 85 | | | | | |
| 62 | 92 | | | | | |
| 63 | 54 | | | | | |
| 64 | 52 | | | | | |
| 65 | 29 | | | 27.6 | | |
| 66 | 1 | | | | | |
| 67 | 2 | | | | | |
| 68 | 4 | | | | | |
| 69 | 0 | | | | | |
| 70 | 3 | | | 1.8 | | |
| 71 | 1 | | | | | |
| 72 | 1 | | | | | |
| 73 | 1 | | | | | |
| 74 | 1 | | | | | |
| 75 | 2 | | | 1 | | |
| 76 | 1 | | | | | |
| 77 | 0 | | | | | |
| 78 | 1 | | | | | |
| 79 | 4 | | | | | |
| 80 | 1 | | | 1.4 | | |
| 81 | 0 | | | | | |
| 82 | 1 | | | | | |
| 83 | 2 | | | | | |

FIG. 7B

830

| | 822 A | 820 B | 824 C | D | 832 E | 834 F |
|---|---|---|---|---|---|---|
| 3 | PeakSum | PeakLength | Peak Sum rounded | | Intensity Bin | Frequency |
| 4 | 1098.270848 | 11 | 1098 | | 1 | 0 |
| 5 | 862.6993164 | 10 | 863 | | 2 | 0 |
| 6 | 663.4211898 | 6 | 663 | | 3 | 0 |
| 7 | 716.1277847 | 9 | 716 | | 4 | 0 |
| 8 | 502.4039113 | 13 | 502 | | 5 | 0 |
| 9 | 234.4171898 | 6 | 234 | | 6 | 0 |
| 10 | 384.2801265 | 4 | 384 | | 7 | 0 |
| 11 | 408.4181898 | 6 | 408 | | 8 | 0 |
| 12 | 1328.998721 | 7 | 1329 | | 9 | 0 |
| 13 | 529.5582531 | 8 | 530 | | 10 | 0 |
| 14 | 462.4191898 | 6 | 462 | | 11 | 0 |
| 15 | 445.8506582 | 5 | 446 | | 12 | 0 |
| 16 | 696.1287847 | 9 | 696 | | 13 | 0 |
| 17 | 431.4191898 | 6 | 431 | | 14 | 0 |
| 18 | 383.8486582 | 5 | 384 | | 15 | 0 |
| 19 | 257.9867215 | 7 | 258 | | 16 | 0 |
| 20 | 810.4241898 | 6 | 810 | | 17 | 0 |
| 21 | 782.8536582 | 5 | 783 | | 18 | 0 |
| 22 | 629.8363796 | 12 | 630 | | 19 | 0 |
| 23 | 798.4241898 | 6 | 798 | | 20 | 0 |
| 24 | 395.9867215 | 7 | 396 | | 21 | 0 |
| 25 | 256.4171898 | 6 | 256 | | 22 | 0 |
| 26 | 660.5449745 | 15 | 661 | | 23 | 0 |
| 27 | 584.4211898 | 6 | 584 | | 24 | 1 |
| 28 | 362.9877215 | 7 | 363 | | 25 | 0 |
| 29 | 434.4191898 | 6 | 434 | | 26 | 2 |
| 30 | 341.8343796 | 12 | 342 | | 27 | 1 |
| 31 | 520.4201898 | 6 | 520 | | 28 | 0 |
| 32 | 351.2791265 | 4 | 351 | | 29 | 0 |
| 33 | 512.4191898 | 6 | 512 | | 30 | 1 |
| 34 | 421.4191898 | 6 | 421 | | 31 | 0 |
| 35 | 594.4201898 | 6 | 594 | | 32 | 2 |
| 36 | 283.2791265 | 4 | 283 | | 33 | 1 |
| 37 | 640.4211898 | 6 | 640 | | 34 | 0 |
| 38 | 426.2801265 | 4 | 426 | | 35 | 0 |
| 39 | 708.1287847 | 9 | 708 | | 36 | 1 |
| 40 | 472.5562531 | 8 | 473 | | 37 | 1 |
| 41 | 381.8486582 | 5 | 382 | | 38 | 0 |

FIG. 8B

FIG. 9B 942 944 Mass and Size Calculations 950 952 Size Histogram 950 954

| Peak Area (counts) | Particle Mass (µg) | Particle size(nm) | | Particle size(nm) | Frequency |
|---|---|---|---|---|---|
| 1 | 3.82105E-12 | 8.86073 | 946 | 8.86073 | 0 |
| 2 | 7.64211E-12 | 11.16382 | | 11.16382 | 0 |
| 3 | 1.14632E-11 | 12.77939 | | 12.77939 | 0 |
| 4 | 1.52842E-11 | 14.06554 | | 14.06554 | 0 |
| 5 | 1.91053E-11 | 15.15164 | | 15.15164 | 0 |
| 6 | 2.29263E-11 | 16.10102 | | 16.10102 | 0 |
| 7 | 2.67474E-11 | 16.94997 | | 16.94997 | 0 |
| 8 | 3.05684E-11 | 17.72147 | | 17.72147 | 0 |
| 9 | 3.43895E-11 | 18.43107 | | 18.43107 | 0 |
| 10 | 3.82105E-11 | 19.08987 | | 19.08987 | 0 |
| 11 | 4.20316E-11 | 19.70609 | | 19.70609 | 0 |
| 12 | 4.58526E-11 | 20.28602 | | 20.28602 | 0 |
| 13 | 4.96737E-11 | 20.83455 | | 20.83455 | 0 |
| 14 | 5.34947E-11 | 21.35563 | | 21.35563 | 0 |
| 15 | 5.73158E-11 | 21.85245 | | 21.85245 | 0 |
| 16 | 6.11369E-11 | 22.32765 | | 22.32765 | 0 |
| 17 | 6.49579E-11 | 22.78344 | | 22.78344 | 0 |
| 18 | 6.87790E-11 | 23.22169 | | 23.22169 | 0 |
| 19 | 7.26000E-11 | 23.64400 | | 23.64400 | 0 |
| 20 | 7.64211E-11 | 24.05173 | | 24.05173 | 0 |
| 21 | 8.024211E-11 | 24.44609 | | 24.44609 | 0 |
| 22 | 8.40632E-11 | 24.82812 | | 24.82812 | 0 |
| 23 | 8.78842E-11 | 25.19875 | | 25.19875 | 0 |
| 24 | 9.17053E-11 | 25.55878 | | 25.55878 | 1 |
| 25 | 9.55263E-11 | 25.90894 | | 25.90894 | 0 |
| 26 | 9.93474E-11 | 26.24989 | | 26.24989 | 2 |
| 27 | 1.03168E-10 | 26.58220 | | 26.58220 | 1 |
| 28 | 1.06989E-10 | 26.90640 | | 26.90640 | 0 |
| 29 | 1.10811E-10 | 27.22298 | | 27.22298 | 0 |
| 30 | 1.14632E-10 | 27.53236 | | 27.53236 | 1 |
| 31 | 1.18453E-10 | 27.83494 | | 27.83494 | 0 |
| 32 | 1.22274E-10 | 28.13107 | | 28.13107 | 2 |
| 33 | 1.26095E-10 | 28.42111 | | 28.42111 | 1 |
| 34 | 1.29916E-10 | 28.70534 | | 28.70534 | 0 |
| 35 | 1.33737E-10 | 28.98405 | | 28.98405 | 0 |
| 36 | 1.37558E-10 | 29.25750 | | 29.25750 | 1 |
| 37 | 1.41379E-10 | 29.52593 | | 29.52593 | 1 |
| 38 | 1.45200E-10 | 29.78957 | | 29.78957 | 0 |
| 39 | 1.49021E-10 | 30.04862 | | 30.04862 | 1 |
| 40 | 1.52842E-10 | 30.55373 | | 30.55373 | 1 |
| 41 | 1.56663E-10 | 30.55373 | | 30.55373 | 0 |
| 42 | 1.60484E-10 | 30.80014 | | 30.80014 | 0 |
| 43 | 1.64305E-10 | 31.04268 | | 31.04268 | 0 |
| 44 | 1.68126E-10 | 31.28147 | | 31.28147 | 1 |
| 45 | 1.71947E-10 | 31.51668 | | 31.51668 | 0 |
| 46 | 1.75768E-10 | 31.74843 | | 31.74843 | 0 |
| 47 | 1.79590E-10 | 31.97685 | | 31.97685 | 1 |
| 48 | 1.83411E-10 | 32.20204 | | 32.20204 | 2 |
| 49 | 1.87232E-10 | 32.42413 | | 32.42413 | 0 |
| 50 | 1.91053E-10 | 30.64322 | | 30.64322 | 1 |

920

| Background: | 2.430468364 | |
|---|---|---|
| 922 | 924 | 926 |
| Conc.(µg/L) | Mass Flux(µg/event) | Counts |
| 0 | 0.00000E+00 | 0.006241252 |
| 1 | 1.50000E-11 | 4.11566168 |
| 5 | 7.50000E-11 | 20.33524525 |
| 20 | 3.00000E-10 | 78.67138513 |
| | | |
| Slope: 934 | 2.617079E+11 | |
| Intercept: 936 | 2.656088E-01 | |

946 942 944 940 928 932

| Background | 2.430468364 | | | | | | | | | | | | | | | |
|---|---|---|---|---|---|---|---|---|---|---|---|---|---|---|---|---|
| Sample | Analyte | Size By Part. (nm) | Size By Diss. (nm) | Peaks | T.E. (%) | Mean Part (counts) | Part. Conc. (parts/mL) | Mean Diss. (counts) | Diss. Conc. (ppb) | Density (g/cm³) | Mass Fraction (%) | Ionization Efficiency(%) | Rpq | Sample Flow Rate (mL/min) | Dwell Time (µs) | Sample Time (s) |
| 60nmAg in 0 ppb | Ag 106.905 | | 61.15557364 | 20845 | 3 | | | 2.4305 | | 10.49 | 100 | 100 | 0.5 | 0.3 | 100 | 100 |

992 994 996

| Conc.(µg/ | Mass Flux | Counts |
|---|---|---|
| 0 | 0 | 0.01377 |
| 5 | 1.52E-10 | 3.292981 |
| 25 | 7.61E-10 | 16.09393 |

| Dwell Time (µs) | Sample Time (s) | T.E. |
|---|---|---|
| 100 | 100 | 6.50% |

| Concentration of added dissolved (ppb) | Measured Size (nm) | Determined Dissolved Conc. (ppb) |
|---|---|---|
| 0 | 60.31 | 0.70 |
| 2 | 59.54 | 1.95 |
| 10 | 58.91 | 11.49 |

1110

| | A | B | C | D | E | F | G | H | I | J | K | L | M | N | O | P | Q | R |
|---|---|---|---|---|---|---|---|---|---|---|---|---|---|---|---|---|---|---|
| 1 | Sample | Analyte | Size By Part.(nm) | Size By Diss.(nm) | Peaks | T.E. (%) | Mean Part. (counts) | Part. Conc. (parts/mL) | Mean Diss. (counts) | Diss. Conc. (ppb) | | Density (g/cm³) | Mass Fraction (%) | Ionization Efficiency (%) | Rpq | Sample FI | Dwell Time (μs) | Sample Time (s) |
| 2 | 1 | Au 196.967 | | 59.97548152 | 2174 | 5.9 | 157.6968721 | 73694.91525 | 18.50014678 | 12.90453866 | | 19.3 | 100 | 100 | 0.5 | 0.3 | 100 | 100 |
| 3 | 2 | Au 196.967 | | 59.73048977 | 2184 | 5.9 | 159.2261905 | 74033.89831 | 18.66234216 | 13.01395543 | | 19.3 | 100 | 100 | 0.5 | 0.3 | 100 | 100 |
| 4 | 3 | Au 196.967 | | 60.17203108 | 2134 | 5.9 | 160.5506092 | 72338.98305 | 18.3735626 | 12.81927579 | | 19.3 | 100 | 100 | 0.5 | 0.3 | 100 | 100 |
| 5 | 4 | Au 196.967 | | 59.85882942 | 2245 | 5.9 | 163.511804 | 76101.69492 | 18.60145017 | 12.97287778 | | 19.3 | 100 | 100 | 0.5 | 0.3 | 100 | 100 |
| 6 | 5 | Au 196.967 | | 59.75938791 | 2133 | 5.9 | 159.1462729 | 72305.08475 | 18.5830127 | 12.96043989 | | 19.3 | 100 | 100 | 0.5 | 0.3 | 100 | 100 |
| 7 | 6 | Au 196.967 | | 59.45619078 | 2093 | 5.9 | 159.7630196 | 70949.15254 | 18.53630985 | 12.92893421 | | 19.3 | 100 | 100 | 0.5 | 0.3 | 100 | 100 |
| 8 | 7 | Au 196.967 | | 59.46740291 | 2136 | 5.9 | 155.3600187 | 72406.77966 | 18.58158235 | 12.95947498 | | 19.3 | 100 | 100 | 0.5 | 0.3 | 100 | 100 |
| 9 | 8 | Au 196.967 | | 59.33885725 | 2140 | 5.9 | 155.8742991 | 72542.37288 | 18.52840638 | 12.92360255 | | 19.3 | 100 | 100 | 0.5 | 0.3 | 100 | 100 |
| 10 | 9 | Au 196.967 | | 59.49410813 | 2140 | 5.9 | 157.8214953 | 72542.37288 | 18.42311157 | 12.85257081 | | 19.3 | 100 | 100 | 0.5 | 0.3 | 100 | 100 |
| 11 | | | | | | | | | | | | | | | | | | |
| 12 | Average | | | 59.694753 | 2153.22 | | 158.77229 | 72990.584 | 18.532235 | 12.926186 | | | | | | | | |
| 13 | Stdev | 1112 | | 0.2771504 | 43.0894 | | 2.4762706 | 1460.6569 | 0.0900115 | 0.0607216 | | | | | | | | |
| 14 | RSD % | | | 0.4642794 | 2.00116 | | 1.5596365 | 2.0011579 | 0.1857021 | 0.4697565 | | | | | | | | |

FIG. 11A

1130

| | A | B | C | D | E | F | G | H | I | J | K | L | M | N | O | P | Q | R |
|---|---|---|---|---|---|---|---|---|---|---|---|---|---|---|---|---|---|---|
| 1 | Sample | Analyte | Size By Part.(nm) | Size By Diss.(nm) | Peaks | T.E. (%) | Mean Part. (counts) | Part. Conc. (parts/mL) | Mean Diss. (counts) | Diss. Conc. (ppb) | | Density (g/cm³) | Mass Fraction (%) | Ionization Efficiency (%) | Rpq | Sample FI | Dwell Time (μs) | Sample Time (s) |
| 2 | 1 | Au 196.967 | | 59.895503 | 4820 | 5.5 | 150.0641 | 175272.7 | 0.034733 | 0.447797 | | 19.3 | 100 | 100 | 0.5 | 0.3 | 100 | 100 |
| 3 | 2 | Au 196.967 | | 59.625988 | 4826 | 5.5 | 146.8346 | 175490.9 | 0.026216 | 0.442051 | | 19.3 | 100 | 100 | 0.5 | 0.3 | 100 | 100 |
| 4 | 3 | Au 196.967 | | 59.563086 | 4924 | 5.5 | 146.6757 | 179054.5 | 0.026269 | 0.442087 | | 19.3 | 100 | 100 | 0.5 | 0.3 | 100 | 100 |
| 5 | 4 | Au 196.967 | | 59.569662 | 4878 | 5.5 | 147.5935 | 177381.8 | 0.026015 | 0.441916 | | 19.3 | 100 | 100 | 0.5 | 0.3 | 100 | 100 |
| 6 | 5 | Au 196.967 | | 59.476719 | 4981 | 5.5 | 145.9659 | 181127.3 | 0.026533 | 0.442265 | | 19.3 | 100 | 100 | 0.5 | 0.3 | 100 | 100 |
| 7 | 6 | Au 196.967 | | 59.553663 | 4747 | 5.5 | 146.6573 | 172618.2 | 0.024734 | 0.441052 | | 19.3 | 100 | 100 | 0.5 | 0.3 | 100 | 100 |
| 8 | 7 | Au 196.967 | | 59.343548 | 4874 | 5.5 | 146.0371 | 177236.4 | 0.025068 | 0.441277 | | 19.3 | 100 | 100 | 0.5 | 0.3 | 100 | 100 |
| 9 | 8 | Au 196.967 | | 59.600874 | 4812 | 5.5 | 147.1874 | 174981.8 | 0.024844 | 0.441126 | | 19.3 | 100 | 100 | 0.5 | 0.3 | 100 | 100 |
| 10 | 9 | Au 196.967 | | 59.393516 | 4839 | 5.5 | 145.827 | 175963.6 | 0.023928 | 0.440508 | | 19.3 | 100 | 100 | 0.5 | 0.3 | 100 | 100 |
| 11 | | | | | | | | | | | | | | | | | | |
| 12 | Average | | | 59.55806 | 4855.67 | | 146.983 | 176570 | 0.02648 | 0.44223 | | | | | | | | |
| 13 | Stdev | 1132 | | 0.158193 | 68.3356 | | 1.29401 | 2484.93 | 0.00321 | 0.00217 | | | | | | | | |
| 14 | RSD % | | | 0.265612 | 1.40734 | | 0.88039 | 1.40734 | 12.1397 | 0.49041 | | | | | | | | |

FIG. 11B

FIG. 11C

1150

1ppb Analyzed as a sample and as a dissolved standard solution, and here are the results.

| Standard | | Mean Dissolved Counts | Peaks detected |
|---|---|---|---|
| | 1 | 2.0887 | NA |
| Sample | | | |
| | 1 | 1.8916 | 1 |
| | 2 | 2.0900 | 0 |
| | 3 | 2.0669 | 0 |
| | 4 | 2.0670 | 0 |
| | 5 | 2.0462 | 0 |
| | 6 | 1.9468 | 1 |
| | Average | 2.0181 | |
| | Stdev | 0.0798 | |

Dwell time = 100 μs
Total time = 100 s

1170

10ppd Au is analyzed as a sample and as a dissolved standard solution, and here are the results

| | | Mean Dissolved Counts | Peaks detected | Error% |
|---|---|---|---|---|
| 1 | Standard | 18.5278 | NA | |
| | Sample | 18.3271 | 11 | 1.08 |
| 2 | Standard | 18.3463 | NA | |
| | Sample | 18.1614 | 11 | 1.01 |
| 3 | Standard | 18.2342 | NA | |
| | Sample | 18.0474 | 8 | 1.02 |
| 4 | Standard | 18.1677 | NA | |
| | Sample | 17.9142 | 10 | 1.40 |
| 5 | Standard | 17.9905 | NA | |
| | Sample | 17.8465 | 14 | 0.80 |
| 6 | Standard | 17.9175 | NA | |
| | Sample | 17.7973 | 8 | 0.67 |
| 7 | Standard | 17.8682 | NA | |
| | Sample | 17.7460 | 12 | 0.68 |
| 8 | Standard | 17.7740 | NA | |
| | Sample | 17.6949 | 14 | 0.45 |
| 9 | Standard | 17.7698 | NA | |
| | Sample | 17.6534 | 13 | 0.66 |
| 10 | Standard | 17.7099 | NA | |
| | Sample | 17.4489 | 5 | 1.47 |
| 11 | Standard | 17.6245 | NA | |
| | Sample | 17.4613 | 9 | 0.93 |
| 12 | Standard | 17.4462 | NA | |
| | Sample | 17.3118 | 5 | 0.94 |
| 13 | Standard | 17.4583 | NA | |
| | Sample | 17.2736 | 7 | 1.06 |
| 14 | Standard | 17.3936 | NA | |
| | Sample | 17.2614 | 7 | 0.76 |

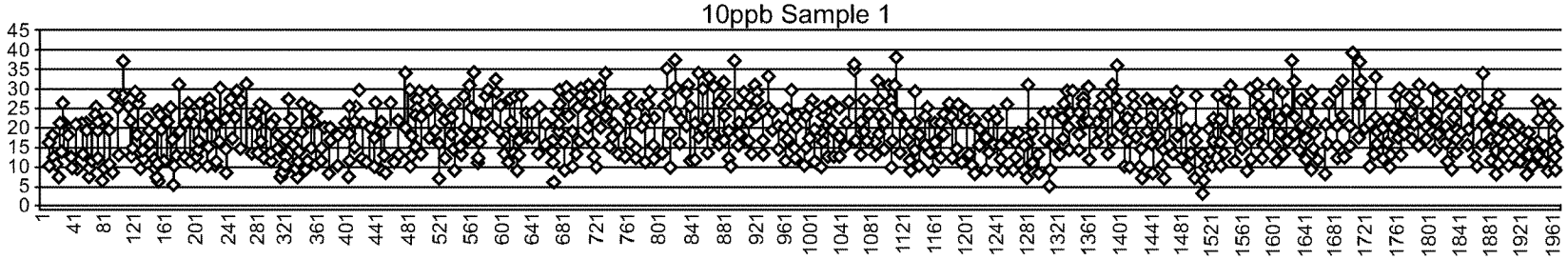

SYSTEMS AND METHODS FOR AUTOMATED ANALYSIS OF OUTPUT IN SINGLE PARTICLE INDUCTIVELY COUPLED PLASMA MASS SPECTROMETRY AND SIMILAR DATA SETS

CROSS REFERENCE TO RELATED APPLICATIONS

This patent application is a continuation of U.S. application Ser. No. 14/181,348, filed on Feb. 14, 2014, the contents of which are incorporated herein by reference in its entirety.

TECHNICAL FIELD

This invention relates generally to analysis of spectrometry data. In particular embodiments, the invention relates to automated peak detection and analysis in single-particle inductively coupled plasma mass spectrometry (SP-ICP-MS).

BACKGROUND

Inductively coupled plasma mass spectrometry (ICP-MS) has been gaining favor with laboratories around the world as the instrument of choice for performing trace metal analysis. ICP-MS instrument detection limits are at or below the single part per billion (ppb) level for much of the periodic table, the analytical working range is nine orders of magnitude, productivity is superior to other techniques, and isotopic analysis can be readily achieved. Most analyses performed on ICP-MS instrumentation are quantitative; however, ICP-MS can perform semi-quantitative analysis as well, identifying an unknown sample for any of 80 detectable, differentiable elements, for example.

In ICP-MS analysis, samples are introduced into an argon plasma as aerosol droplets. The plasma dries the aerosol, dissociates the molecules, then removes an electron from the components, thereby forming singly-charged ions, which are directed into a mass filtering device known as a mass spectrometer. Most commercial ICP-MS systems employ a quadrupole mass spectrometer which rapidly scans the mass range. At any given time, only one mass-to-charge ratio will be allowed to pass through the mass spectrometer from the entrance to the exit. Upon exiting the mass spectrometer, ions strike the first dynode of an electron multiplier, which serves as a detector. The impact of the ions releases a cascade of electrons, which are amplified until they become a measurable pulse. The intensities of the measured pulses are compared to standards, which make up a calibration curve for a particular element, to determine the concentration of that element in the sample.

Most ICP-MS instruments include the following components: a sample introduction system composed of a nebulizer and spray chamber; an ICP torch and RF coil for generating the argon plasma that serves as the ion source; an interface that links the atmospheric pressure ICP ion source to a high vacuum mass spectrometer; a vacuum system that provides high vacuum for ion optics, quadrupole, and detector; a collision/reaction cell that precedes the mass spectrometer and is used to remove interferences that can degrade achievable detection limits; ion optics that guide the desired ions into the quadrupole while assuring that neutral species and photons are discarded from the ion beam; a mass spectrometer that acts as a mass filter to sort ions by their mass-to-charge ratio (m/z); a detector that counts individual ions exiting the quadrupole; and a data handling and system controller that controls aspects of instrument control and data handling for use in obtaining final concentration results.

Single-particle (SP) ICP-MS is a recently developed technique useful for detecting and sizing metal-containing nanoparticles at very low levels with great precision and accuracy. The detection of such nanoparticles is important in a variety of fields, particularly environmental health. For example, while there is great interest in the use of engineered nanomaterials in a wide variety of industrial and commercial applications, such nanoparticles may be harmful to humans. A 2009 study in the Journal of Nanoparticle Research showed that zinc oxide nanoparticles were toxic to human lung cells in lab tests even at low concentrations (Weisheng et al., Journal of Nanoparticle Research, 2009, Vol. 11, No. 1, pp. 25-39). Other studies have shown that tiny silver particles (15 nm) killed liver and brain cells in laboratory rats (Braydich-Stolle et al., Toxicological Sciences, 2005, Vol. 88, Issue 2, pp. 412-419). At the nano scale, particles are more chemically reactive and bioactive, allowing them to more easily penetrate organs and cells. Thus, it is important to assess nanoparticle fate, transformation, and transportation in different matrices, e.g., environmental, biological, food, etc. SP-ICP-MS provides a technique for performing such difficult analyses.

In SP-ICP-MS, a dilute solution of a dissolved metal will produce a relatively constant signal, while signals from solid nanoparticles that are suspended in the solution are detected as single-point pulses or multi-point peaks whose intensity exceeds the background signal from the dissolved metal. Thus, single particle mode analysis (SP-ICP-MS) allows the differentiation between signals produced by dissolved analyte and signals produced by solid nanoparticle analyte.

In order for SP-ICP-MS to work at low nanoparticle concentrations, the speed of data acquisition and the response time of the ICP-MS quadrupole and detector must be fast enough to capture the pulses/peaks corresponding to the nanoparticles. Sequences of pulses/peaks can be identified and quantified by an instrument running with a short enough dwell time (e.g., a few milliseconds or shorter) to resolve the individual nanoparticle pulses/peaks in the time domain. For example, the NexION® 300 ICP-MS, manufactured by PerkinElmer of Shelton, Conn., can be operated in Single Particle mode with a high-speed mass analyzer at a scan rate that exceeds 100,000 data points per second, a read speed that exceeds 3000 points per second, and a detector capable of integrating ionic signals at a dwell time of 10 microseconds without any settling time in between. The NexION® 300 ICP-MS has a unique ion path design, e.g., the Triple Cone Interface (TCI) and Quadrupole Ion Deflector (QID), that allows this high level performance for nanoparticle detection.

Pulse height or area under a peak is compared against calibration standards to determine the concentration of the particles in the sample and the mass and size distribution of the particles in the sample. Coupled with a size-separation technique, e.g., field flow fractionation (FFF) and liquid chromatography (LC), SP-ICP-MS is capable of addressing size, size distribution, surface charge, and surface functionality of nanoparticles in samples.

Previous SP-ICP-MS techniques produced a single data point per nanoparticle detected. Such techniques require multiple sample dilutions in order to obtain single data points representing only one nanoparticle each, rather than multiple nanoparticles per pulse. These multiple dilutions introduce additional error, as well as potential data artifacts, which affect the accuracy of the results.

Newer SP-ICP-MS techniques, such as those performed with high performance instrumentation such as the NexION® 300 ICP-MS, acquire data at extremely fast rates and are capable of acquiring multiple data points per nanoparticle, thereby producing a multi-point peak per nanoparticle, rather than a single-point pulse. These techniques offer significantly improved precision and accuracy, and obviate or reduce the need for multiple sample dilutions prior to running a sample. However, these newer techniques produce extremely large data sets (e.g., several million to tens of millions or more pulse counts per sample run) and complicate data analysis. Even with today's fast computational speeds, such large data sets require significant processing time. Because of the size of the data sets and the nature of the data, individual researchers implementing the SP-ICP-MS techniques routinely perform their own data analysis, which often involves some degree of estimation or other qualitative judgment, thereby introducing inaccuracy and lack of precision and/or reproducibility.

There is a need for a highly efficient, automated technique for processing spectrometry data, such as data sets obtained during SP-ICP-MS analysis.

SUMMARY OF THE INVENTION

Described herein are methods and systems for automated analysis of spectrometry data corresponding to particles of a sample, such as large data sets obtained during single particle mode analysis of an inductively coupled plasma mass spectrometer (SP-ICP-MS). In such data sets, there are multiple data points for any given peak representing a single detected particle, e.g., a solid nanoparticle, and there is a background signal that can interfere with the accuracy and/or precision of the analysis. Techniques are presented herein that provide appropriate smoothing for rapid data processing without an accompanying reduction (or with an acceptably negligible reduction) in accuracy and/or precision.

Single-particle (SP) ICP-MS is a recently developed technique useful for detecting and sizing metallic nanoparticles at very low levels (e.g., <1 part-per-billion, or as low as 1 part-per-trillion) with great precision and accuracy. The detection of such nanoparticles is important in a variety of fields, particularly environmental health, where even low concentrations of nanoparticles may cause deleterious effects on human health. Single particle mode analysis (SP-ICP-MS) techniques are powerful because they permit differentiation between signals produced by analyte in a sample that is in a dissolved form, and analyte that is in the form of solid nanoparticles. In SP-ICP-MS systems, a dilute solution of a dissolved analyte (e.g., a metal element) produces a relatively constant signal, while signals from solid nanoparticles composed of the same analyte, said nanoparticles being suspended in the solution, are detected as either single-point pulses or multi-point peaks whose intensity exceeds the background signal from the dissolved analyte. Certain slower SP-ICP-MS systems that can only obtain single-point pulses often require sample dilution by a factor of 10,000 or more to provide a testing sample with differentiable nanoparticle signals. Such high dilution factors often introduce unacceptable error and/or artifacts which diminish the accuracy and precision of the results.

Advanced SP-ICP-MS systems provide fast acquisition of pulse count values with a very short dwell time and settling time, thereby permitting multiple data points (multiple pulse count values) to be obtained for any given nanoparticle. This increases the accuracy and precision of the data analysis and promotes the ability to differentiate between a signal obtained from analyte in dissolved form and analyte in solid nanoparticle form without requiring such extensive sample dilutions. However, because of the huge amount of data produced during a given SP-ICP-MS sample run, very efficient data processing is needed to avoid high processing time requirements.

In particular, in certain embodiments, the techniques presented herein involve accessing an array of SP-ICP-MS pulse count values that include multiple data points for each detected particle, and determining a threshold for identifying (and excluding from the array in subsequent iterations) pulse count values as corresponding to a peak signal (and not a background signal). The threshold is adjusted based on remaining pulse count values following each of a series of iterations, with a given subsequent iteration further excluding pulse count values identified as corresponding to a peak in the preceding iteration. A final background threshold is determined upon convergence of the threshold within acceptable tolerance.

Embodiments described herein provide an efficient, accurate, precise, and automated way to determine particle mass and/or particle size corresponding to a given peak for a sample analyzed via SP-ICP-MS. The techniques also work for analysis of other data sets which—as with SP-ICP-MS data sets—contain multiple data points for any given peak representing a single detected particle and which contain a background signal that can interfere with the accuracy and/or precision of the analysis if not properly accounted for. The techniques described herein further allow automated determination of the mass distribution and/or size distribution of the particles in the sample, as well as determination of particle concentration, a mean particle size, a median particle size, most common particle size, and a dissolved analyte concentration for the sample. Moreover, the techniques allow determination of the composition of the particles, they allow characterization of agglomeration of the particles, and they allow differentiation between the detected ionic and particulate signals.

In one aspect, the invention is directed to a method for automated analysis of spectrometry data corresponding to particles of a sample, the method comprising: (a) accessing, by a processor of a computing device, a sequence of pulse count values (e.g., intensity values) acquired by a spectrometer (e.g. an inductively coupled plasma mass spectrometer (ICP-MS)), at a rate fast enough (e.g., at a short enough dwell time and/or settling time) to produce, for at least one given peak corresponding to an individual particle comprising an analyte in the sample, a plurality of pulse count values each of which is greater than a threshold background intensity value; (b) determining, by the processor, from a first array of the pulse count values, a threshold for identifying (and excluding from the array in subsequent iterations) pulse count values as corresponding to a peak signal (and not a background signal), and adjusting the threshold based on remaining pulse count values following each of a series of iterations, with a given subsequent iteration further excluding pulse count values identified as corresponding to a peak in the preceding iteration, wherein a final background threshold is determined (e.g., and a background level is determined, e.g., where the background level can be used to determine a dissolved analyte concentration in the sample) upon convergence of the threshold within acceptable tolerance; (c) building, by the processor, from the first array of the pulse count values, a smoothed data array (e.g., an x-point averaged data array, e.g., where x is an integer from 1 to 100, or from 3 to 20, e.g., 5), identifying as peaks the values of the smoothed data array (e.g., the x-point averaged data array) that are larger than both subsequent and preceding values (e.g., the subsequent and the preceding averaged values) and larger than the final background threshold; (d) identifying, by the processor, a peak area intensity corresponding to each of the identified peaks for the sample and constructing, by the processor, a histogram of peak area intensities for the sample; (e) computing, by the processor, using the histogram of peak area intensities for the sample, one or more of (i) to (ix) as follows: (i) a particle mass histogram for the sample, (ii) a particle size histogram for the sample, (iii) a number of peaks detected for the sample, (iv) a particle concentration for the sample, (v) a mean particle size for the sample, (vi) a median particle size for the sample, (vii) a dissolved analyte concentration for the sample, (viii) a mode particle size, i.e., the most common particle size, and (ix) a measure of width of particle size distribution (e.g., standard deviation, full width at half maximum (FWHM), or span from the size containing 10% of the particles to the size containing 90% of the particles, or any other choice of two different percentages); and (f) rendering, by the processor, for presentation on a display, a graphical and/or alphanumeric representation of one or more of (i) to (xi) as follows: (i) the identified peaks for the sample, (ii) the histogram of peak area intensities for the sample, (iii) the particle mass histogram for the sample, (iv) the particle size histogram for the sample, (v) the number of peaks detected for the sample, (vi) the particle concentration for the sample, (vii) the mean particle size for the sample, (viii) the median particle size for the sample, (ix) the dissolved analyte concentration for the sample, (x) the mode particle size, i.e., the most common particle size, and (xi) the measure of width of particle size distribution (e.g., standard deviation, full width at half maximum (FWHM), or span from the size containing 10% of the particles to the size containing 90% of the particles, or any other choice of two different percentages).

In certain embodiments, the spectrometer is an inductively coupled plasma mass spectrometer (ICP-MS). In certain embodiments, the particles in the sample are nanoparticles. In certain embodiments, the particles in the sample are microparticles or cells.

In certain embodiments, the sequence of pulse count values contain an average of from 1 to 50, or from 1 to 25, or from 2 to 10, or no less than 1.1, or no less than 1.2, or no less than 1.5, or no less than 2, or no less than 3, or no less than 4, or no less than 5 pulse count values per peak in the sample.

In certain embodiments, the threshold for at least one iteration in step (b) is computed as an average of remaining values in the array plus a multiple of the standard deviation (e.g., average+3 times std dev). In certain embodiments, step (c) further comprises storing positions of the identified peaks in a peak position array and, optionally, repeating step (c) with one or more additional x-values and, optionally, converging on an acceptable x-value. In certain embodiments, the smoothed data array is an x-point averaged data array and step (c) comprises building the x-point averaged data array to produce smoothed data, where x is a predetermined integer (e.g., from 3 to 20), and wherein step (c) further comprises identifying an average number of pulse count values per identified peak in the first array of pulse count values using the x-point averaged data array, then building, from the first array of the pulse count values, an x'-point averaged data array, identifying as peaks the values of the x'-point averaged data array that are larger than both subsequent and preceding averaged values and larger than the final background threshold, where x' is determined from the average number of pulse count values per identified peak using the x-point averaged data array [e.g. x'=round(avg. points per peak+1)], then proceeding to step (d) to identify the peak area intensity corresponding to each of the peaks identified using the x'-point averaged data array.

In certain embodiments, step (e) comprises constructing, by the processor, a mass flux calibration for the sample using: a transport efficiency value for the sample, a dissolved solution calibration for the analyte (e.g., a metallic element of which the particles of the sample are comprised), and a dwell time and a flow rate for the sample in the spectrometer (e.g., ICP-MS). In certain embodiments, step (e) further comprises computing the particle mass histogram for the sample using: (i) the histogram of peak area intensities for the sample, (ii) the mass flux calibration for the sample, (iii) a mass fraction of the particle that is the analyte, (iv) an ionization efficiency, (v) a determined or known shape of the particles, and (vi) a determined or known density of the particles.

In certain embodiments, step (e) comprises determining, by the processor, an intensity versus mass calibration for the sample using: (i) a most-common intensity determined from an intensity histogram produced from an ICP-MS run of a standard particle having a known size and the same composition as the sample (e.g., same analyte), (ii) a determined or known shape of the particles of the sample, and (iii) a determined or known density of the particles of the sample. In certain embodiments, step (e) further comprises computing the particle mass histogram for the sample using: (i) the intensity versus mass calibration for the sample, (ii) a mass fraction of the particle that is the analyte, and (iii) an ionization efficiency.

In certain embodiments, dwell time for each pulse count is no greater than 10 milliseconds, no greater than 1 millisecond, no greater than 500 microseconds, no greater than 200 microseconds, no greater than 100 microseconds, no greater than 50 microseconds, or no greater than 10 microseconds. In certain embodiments, dwell time for each pulse count is a value from 10 microseconds to 500 microseconds, or from 10 microseconds to 200 microseconds. In certain embodiments, settling time for the sample is no greater than 200 microseconds, no greater than 100 microseconds, no greater than 50 microseconds, no greater than 10 microseconds, no greater than 5 microseconds, no greater than 3 microseconds, no greater than 2 microseconds, no greater than 1 microsecond, no greater than 0.5 microsecond, no greater than 0.1 microsecond, or zero.

In certain embodiments, particles of the sample comprise at least one metallic element (analyte). In certain embodiments, particles of the sample comprise at least one member (analyte) selected from the group consisting of Li, Be, B, Na, Mg, Al, Si, P, S, Cl, Ar, K, Ca, Sc, Ti, V, Cr, Mn, Fe, Co, Ni, Cu, Zn, Ga, Ge, As, Se, Br, Kr, Rb, Sr, Y, Zr, Nb, Mo, Tc, Ru, Rh, Pd, Ag, Cd, In, Sn, Sb, Te, I, Xe, Cs, Ba, La, Hf, Ta, W, Re, Os, Ir, Pt, Au, Hg, Tl, Pb, Bi, Ce, Pr, Nd, Sm, Eu, Gd, Tb, Dy, Ho, Er, Tm, Yb, Lu, Th, Pa, and U. In certain embodiments, particles of the sample all have substantially the same composition.

In certain embodiments, the method further comprises the step of acquiring the sequence of pulse count values using the spectrometer (e.g., an inductively coupled plasma mass spectrometer, ICP-MS).

In certain embodiments, the method further comprises the step of displaying the graphical and/or alphanumeric representation of one or more of (i) to (xi) rendered in step (f).

In certain embodiments, the pulse count values acquired by the spectrometer are filtered and/or normalized by the processor before being entered into (or considered as) the first array of the pulse count values and proceeding with step (b).

In another aspect, the invention is directed to a system for automated analysis of spectrometry data corresponding to particles of a sample, the system comprising: a processor; and a memory, wherein the memory comprises instructions that, when executed by the processor, cause the processor to: (a) access a sequence of pulse count values (e.g., intensity values) acquired by a spectrometer at a rate fast enough (e.g., at a short enough dwell time and/or settling time) to produce, for at least one given peak corresponding to an individual particle comprising an analyte in the sample, a plurality of pulse count values each of which is greater than a threshold background intensity value; (b) determine, from a first array of the pulse count values, a threshold for identifying (and excluding from the array in subsequent iterations) pulse count values as corresponding to a peak signal (and not a background signal), and adjust the threshold based on remaining pulse count values following each of a series of iterations, with a given subsequent iteration further excluding pulse count values identified as corresponding to a peak in the preceding iteration, wherein a final background threshold is determined (e.g., and a background level is determined, e.g., where the background level can be used to determine a dissolved analyte concentration in the sample) upon convergence of the threshold within acceptable tolerance; (c) build, from the first array of the pulse count values, a smoothed data array (e.g., an x-point averaged data array, e.g., where x is an integer from 1 to 100 or from 3 to 20, e.g., 5), identifying as peaks the values of the smoothed data array (e.g., the x-point averaged data array) that are larger than both subsequent and preceding values (e.g., the subsequent and the preceding averaged values) and larger than the final background threshold; (d) identify a peak area intensity corresponding to each of the identified peaks for the sample and construct a histogram of peak area intensities for the sample; (e) compute, using the histogram of peak area intensities for the sample, one or more of (i) to (ix) as follows: (i) a particle mass histogram for the sample, (ii) a particle size histogram for the sample, (iii) a number of peaks detected for the sample, (iv) a particle concentration for the sample, (v) a mean particle size for the sample, (vi) a median particle size for the sample, (vii) a dissolved analyte concentration for the sample, (viii) a mode particle size, i.e., the most common particle size, and (ix) a measure of width of particle size distribution (e.g., standard deviation, full width at half maximum (FWHM), or span from the size containing 10% of the particles to the size containing 90% of the particles, or any other choice of two different percentages); and (f) render for presentation on a display, a graphical and/or alphanumeric representation of one or more of (i) to (xi) as follows: (i) the identified peaks for the sample, (ii) the histogram of peak area intensities for the sample, (iii) the particle mass histogram for the sample, (iv) the particle size histogram for the sample, (v) the number of peaks detected for the sample, (vi) the particle concentration for the sample, (vii) the mean particle size for the sample, (viii) the median particle size for the sample, (ix) the dissolved analyte concentration for the sample, (x) the mode particle size, i.e., the most common particle size, and (xi) the measure of width of particle size distribution (e.g., standard deviation, full width at half maximum (FWHM), or span from the size containing 10% of the particles to the size containing 90% of the particles, or any other choice of two different percentages).

In certain embodiments, the system further comprises the spectrometer for acquiring the sequence of pulse count values for the sample, wherein the spectrometer is an inductively coupled plasma mass spectrometer (ICP-MS). In certain embodiments, the ICP-MS comprises: a sample introduction system (e.g., (i) a nebulizer and a spray chamber, (ii) a microdroplet generator system, and/or (iii) a direct injection high efficiency nebulizer); an ICP torch and RF coil for generating an argon plasma that serves as an atmospheric pressure ion source; an interface that links the atmospheric pressure ICP ion source to a high vacuum mass spectrometer; a vacuum system that provides high vacuum for ion optics, a quadrupole, and a detector; a collision/reaction cell that precedes the mass spectrometer and is configured to remove interferences that can degrade achievable detection limits; the ion optics that guide the desired ions into the quadrupole while assuring that neutral species and photons are discarded from the ion beam; a mass spectrometer that acts as a mass filter to sort ions by their mass-to-charge ratio (m/z); a detector that counts individual ions exiting the quadrupole; and a data handling and system controller that controls aspects of instrument control and data acquisition and processing for use in obtaining final concentration results, wherein the processor is part of the data handling and system controller.

In another aspect, the invention is directed to a non-transitory computer readable medium having instructions stored thereon, wherein the instructions, when executed by a processor, cause the processor to: (a) access a sequence of pulse count values (e.g., intensity values) acquired by a spectrometer at a rate fast enough (e.g., at a short enough dwell time and/or settling time) to produce, for at least one given peak corresponding to an individual particle comprising an analyte in the sample, a plurality of pulse count values each of which is greater than a threshold background intensity value; (b) determine, from a first array of the pulse count values, a threshold for identifying (and excluding from the array in subsequent iterations) pulse count values as corresponding to a peak signal (and not a background signal), and adjust the threshold based on remaining pulse count values following each of a series of iterations, with a given subsequent iteration further excluding pulse count values identified as corresponding to a peak in the preceding iteration, wherein a final background threshold is determined (e.g., and a background level is determined, e.g., where the background level can be used to determine a dissolve analyte concentration in the sample) upon convergence of the threshold within acceptable tolerance; (c) build, from the first array of the pulse count values, a smoothed data array (e.g., an x-point averaged data array, e.g., where x is an integer from 1 to 100 or from 3 to 20, e.g., 5), identifying as peaks the values of the smoothed data array (e.g., the x-point averaged data array) that are larger than both subsequent and preceding values (e.g., the subsequent and the preceding averaged values) and larger than the final background threshold; (d) identify a peak area intensity corresponding to each of the identified peaks for the sample and construct a histogram of peak area intensities for the sample; (e) compute, using the histogram of peak area intensities for the sample, one or more of (i) to (ix) as follows: (i) a particle mass histogram for the sample, (ii) a particle size histogram for the sample, (iii) a number of peaks detected for the sample, (iv) a particle concentration for the sample, (v) a mean particle size for the sample, (vi) a median particle size for the sample, (vii) a dissolved analyte concentration for the sample, (viii) a mode particle size, i.e., the most common particle size, and (ix) a measure of width of particle size distribution (e.g., standard deviation, full width at half maximum (FWHM), or span from the size containing 10% of the particles to the size containing 90% of the particles, or any other choice of two different percentages); and (f) render for presentation on a display, a graphical and/or alphanumeric representation of one or more of (i) to (xi) as follows: (i) the identified peaks for the sample, (ii) the histogram of peak area intensities for the sample, (iii) the particle mass histogram for the sample, (iv) the particle size histogram for the sample, (v) the number of peaks detected for the sample, (vi) the particle concentration for the sample, (vii) the mean particle size for the sample, (viii) the median particle size for the sample, (ix) the dissolved analyte concentration for the sample, (x) the mode particle size, i.e., the most common particle size, and (xi) the measure of width of particle size distribution (e.g., standard deviation, full width at half maximum (FWHM), or span from the size containing 10% of the particles to the size containing 90% of the particles, or any other choice of two different percentages).

In certain embodiments, features described with respect to one aspect of the invention (e.g., a method), may also apply to another aspect of the invention (e.g., a system or a non-transitory computer readable medium).

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIG. 6B is a small portion of the data set showing iterations performed for background determination of SP-ICP-MS data per the method of FIG. 1, and result obtained, according to an illustrative embodiment.

FIG. 7B is a small portion of data set showing steps performed for peak detection of SP-ICP-MS experimental data per the method of FIG. 1, according to an illustrative embodiment.

FIG. 8B is a small portion of data used to prepare the intensity histogram of FIG. 8A, according to an illustrative embodiment.

FIGS. 9B, 9C, 9D, and 9E depict computations, a size histogram, an intensity histogram, and calibrations used in performing mass and size calculations and producing the size histogram for experimental SP-ICP-MS data per the method of FIG. 1, according to an illustrative embodiment.

FIGS. 11A, 11B, and 11C show computations of average particle size and standard deviation for known samples from SP-ICP-MS experimental data to demonstrate accuracy and precision of the method of FIG. 1 for determining average particle size and differentiating analyte in solid particle form from dissolved analyte, according to an illustrative embodiment.

Figure 1:
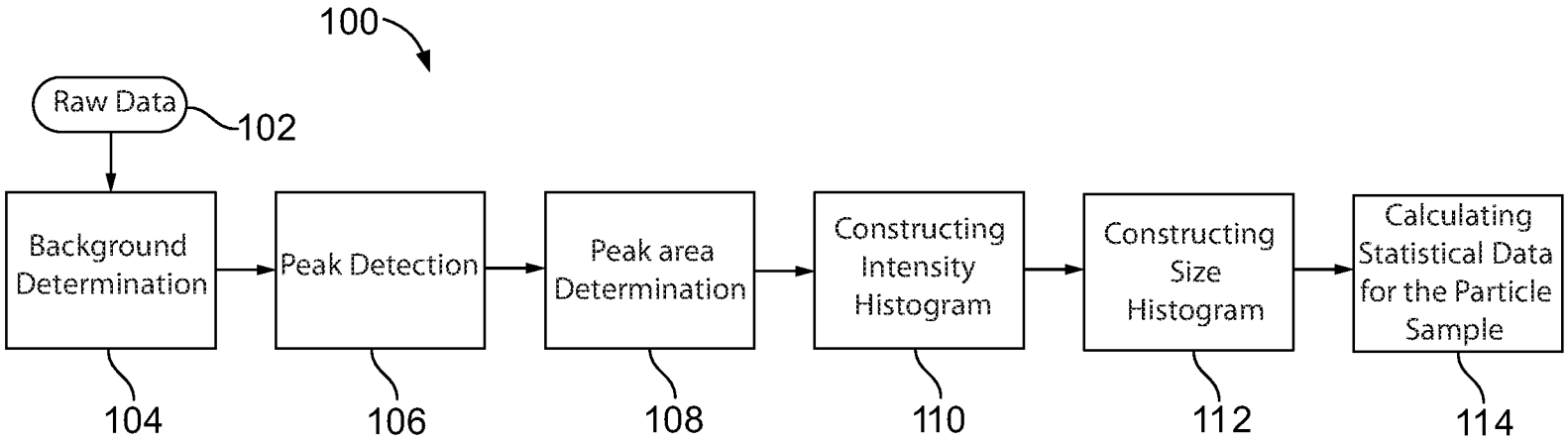
FIG. 1 is a flow chart of a method for automated detection and analysis of data peaks in raw data acquired by an ICP-MS system, where each of the peaks have multiple points and each peak corresponds to a nanoparticle of a sample, according to an illustrative embodiment of the invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

It is contemplated that systems, devices, methods, and processes of the claimed invention encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

FIG. 1 is a flow chart of an illustrative method for automated detection and analysis of data peaks in raw data acquired by an ICP-MS system, where at least some of the peaks have multiple points and each peak corresponds to a nanoparticle of a sample, according to an illustrative embodiment.

Method 100 of FIG. 1 begins with accessing raw data comprising a sequence of pulse count values (e.g., intensity values) acquired by an ICP-MS system (102). The raw data is analyzed to determine a background level, wherein the background level corresponds to the level at which the raw data does not exceed a meaningful threshold value (104). In some implementations, the background level is determined using a multi-pass algorithm, wherein the algorithm is iteratively executed until the background threshold converges to be within acceptable tolerance.

The data is then analyzed to determine peaks in excess of the background level (106). The data points corresponding to the peaks are then used to determine the peak area intensities, corresponding to the area under the peaks which exceed the background level (108). An intensity histogram is constructed from the peak area intensities (110). A size histogram is constructed from the intensity histogram (112). The size histogram is analyzed to determine statistical data for the particle sample (114).

Figure 2:
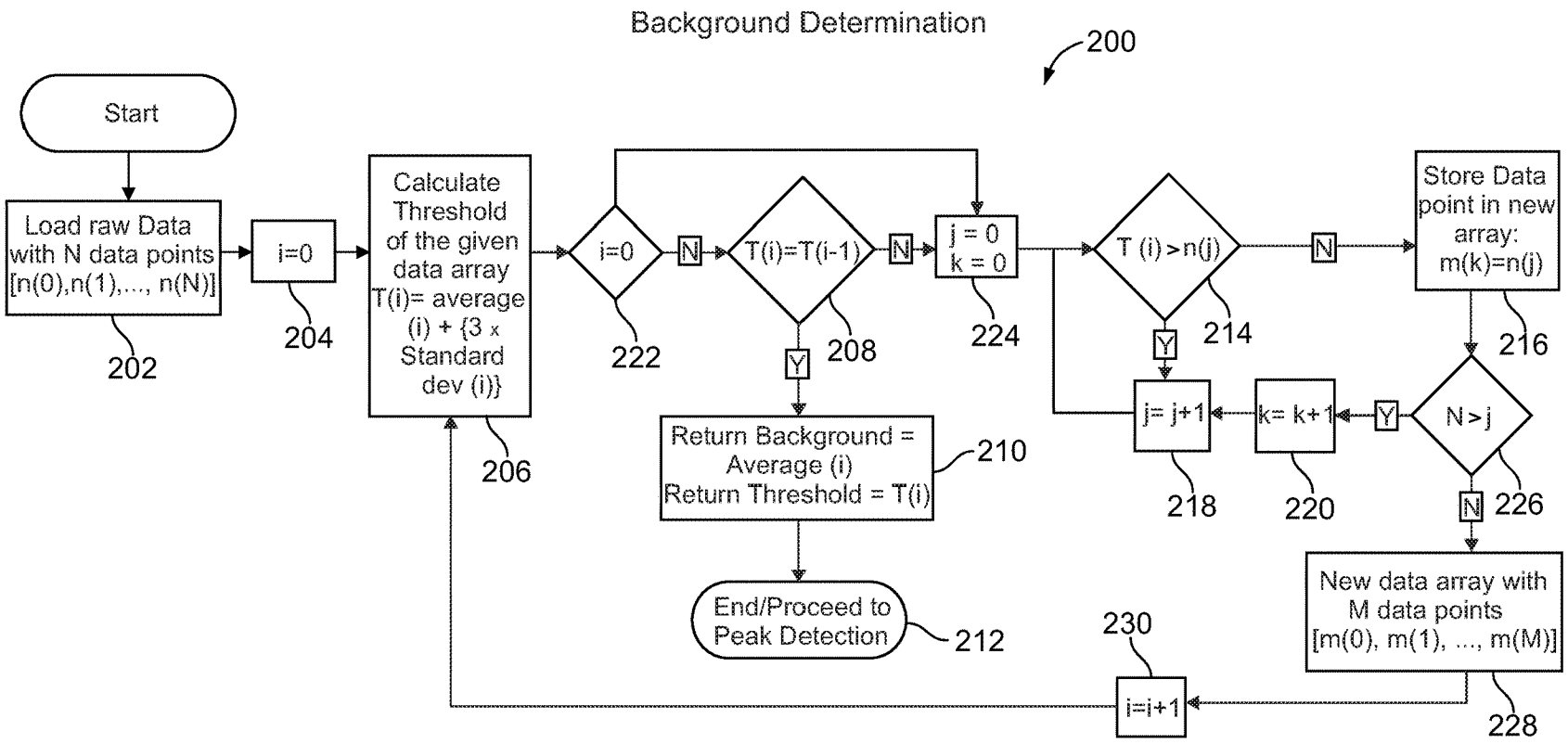
FIG. 2 is a flow chart depicting steps in the Background Determination block of the method of FIG. 1, according to an illustrative embodiment of the invention.

FIG. 2 is an illustrative embodiment of a flow chart depicting steps in the Background Determination block of the method of FIG. 1.

Background Determination Method 200 begins by loading raw data, e.g., all of the data points acquired by the ICP-MS system (202). This raw data is used in the initial iteration of the Background Determination Method 200 (i.e., i=0, the 0th iteration) (204, 222).

The threshold approximation for the initial iteration is calculated by the average of the data points plus three times the standard deviation of the data set (e.g., the threshold function, T(i)=Average(i)+(3*Standard dev. (i)) (206). In subsequent iterations, the threshold approximation is calculated by the same threshold function T (206), but uses a reduced data set consisting only of those data points which were less than or equal to the threshold approximation of the previous iteration (214, 216, 218, 220, 226, 228, 230).

The most recent iteration of the threshold approximation is compared to the threshold approximation of the previous iteration to determine if they are approximately equal (i.e., the threshold level has converged). Based on a positive determination, the final threshold level is calculated by the threshold function of the final iteration of the data set, and the final background level is calculated by the average of the final iteration of the data set. Based on a negative determination, the data set is further processed (208) to reduce the data set to those data points which are less than or equal to the most recent iteration of threshold approximation, according to steps 214, 216, 218, 220, 226, 228, 230.

Figure 3:
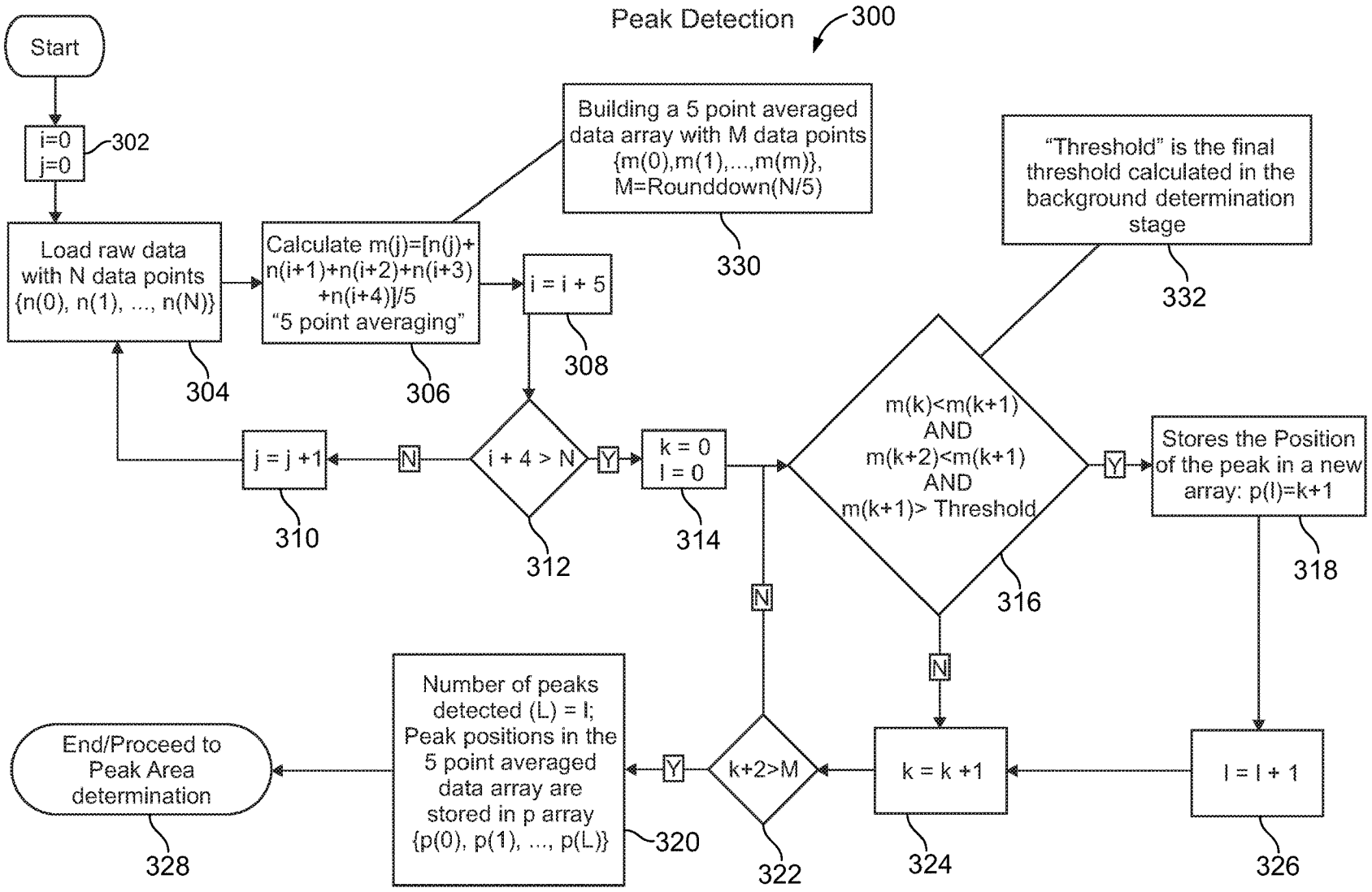
FIG. 3 is a flow chart depicting steps in the Peak Detection block of the method of FIG. 1, according to an illustrative embodiment of the invention.

FIG. 3 is a flow chart depicting steps in the Peak Detection block of the method of FIG. 1, according to the illustrative embodiment.

Peak Detection Method 300 begins by loading raw data acquired by the ICP-MS system (304). A five point averaged data array is constructed from the raw data, wherein each consecutive set of five points is averaged (e.g., Average (points 1-5), Average(points 6-10), etc.) and these averages are used to construct a new array (304, 306, 308, 310, 312). In some implementations, the size of the new array will be approximately one fifth of the size of the raw data array (330).

The five point averaged data array is then analyzed to detect those points which represent peaks, wherein a point is determined to be a peak if the value of the point is greater than both the preceding point and the following point in the array, and the value of the point exceeds the threshold level determined in the Background Determination Method 200 (316, 318, 322, 324, 326). These peak positions are stored in a new array representing the position of the peaks detected (318). The number of times a peak is detected is counted to determine the total number of peaks (320).

Figure 4:
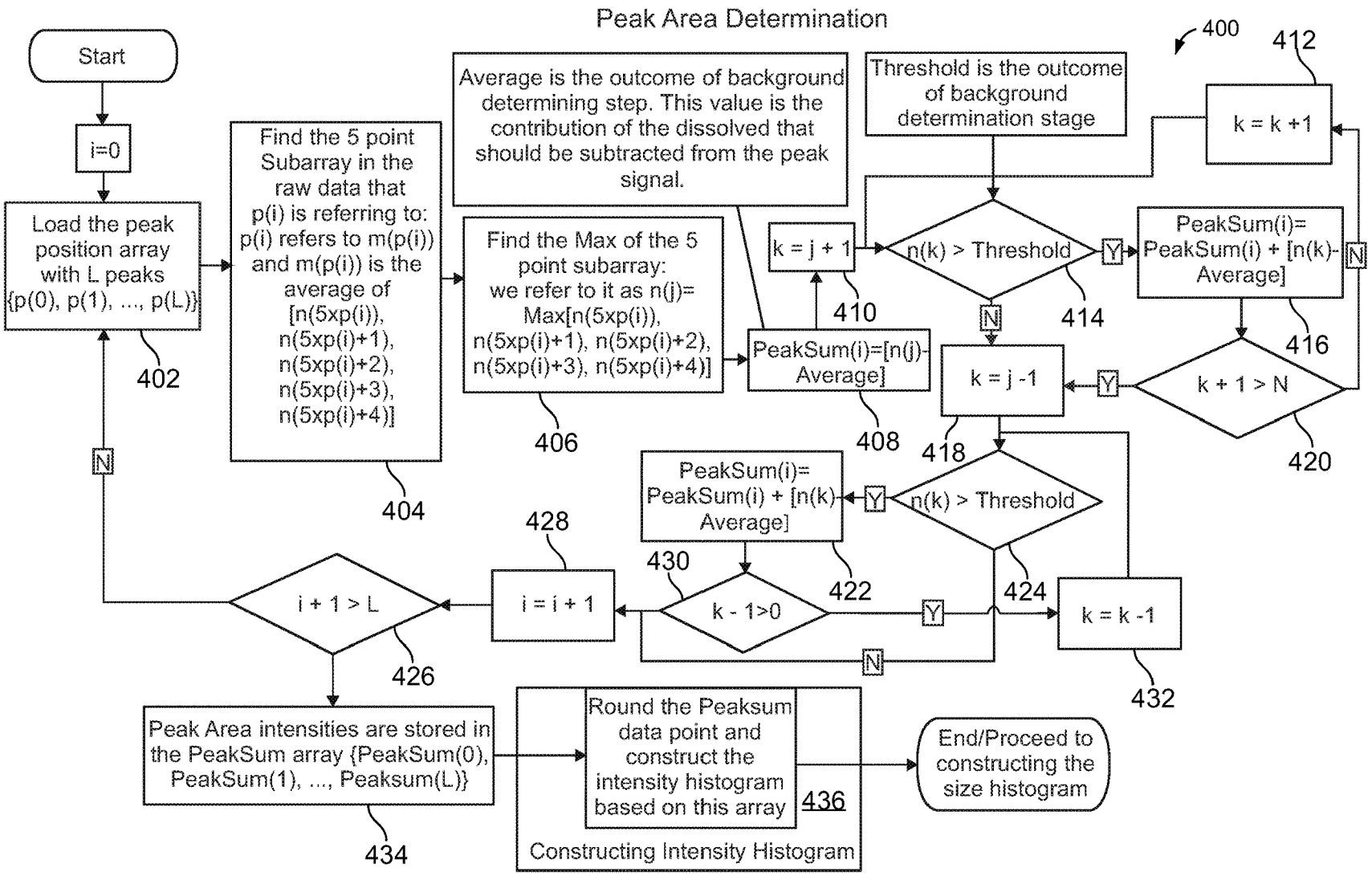
FIG. 4 is a flow chart depicting steps in the Peak Area Determination block and the Constructing Intensity Histogram block of the method of FIG. 1, according to an illustrative embodiment of the invention.

FIG. 4 is a flow chart depicting steps in the Peak Area Determination block and the Constructing Intensity Histogram block of the method of FIG. 1, according to the illustrative embodiment.

Peak Area Determination Method 400 begins by loading the peak position array constructed in Peak Detection Method 300 (402). Each entry in the peak position array indicates that an actual peak occurs within a five point subarray of the raw data acquired by the ICP-MS system, wherein the five point subarray corresponds to the five consecutive points within the raw data which are centered on the indicated peak position (404). The peak data point contained in the five point subarray is then determined by finding the maximum value within the five point subarray (406).

A summation of area corresponding to the peak is initiated by populating a summation variable with the value of the peak point, less the background level determined in Background Determination Method 200 (408). This background level corresponds to the contribution of the dissolved analyte and is subtracted from the value of any point that is added to the summation variable (416, 422). Each point to the right of the peak is iteratively added to the area summation until a point is determined to be less than or equal to the threshold level determined in Background Determination Method 200 (414), or the end of the raw data is reached (420). Subsequently, each point to the left of the peak is iteratively added to the area summation until a point is determined to be less than or equal to the threshold level (424), or the beginning of the raw data is reached (430). Thus, a value less than or equal to the threshold, or the end of the data, comprise the limits to the area considered to correspond to a particular peak value. In certain implementations, the horizontal component (e.g., time steps) of the area may be recorded in a separate array, but although such information may be useful, it is not necessary to record this information.

The described summation of area is calculated for each of the peaks in the peak position array and the summations are added to a new peak summation array (434). The peak summation array is rounded to a whole number and used to construct an intensity histogram, wherein the intensity histogram corresponds to the frequency of any particular peak intensity (area).

Figure 5:
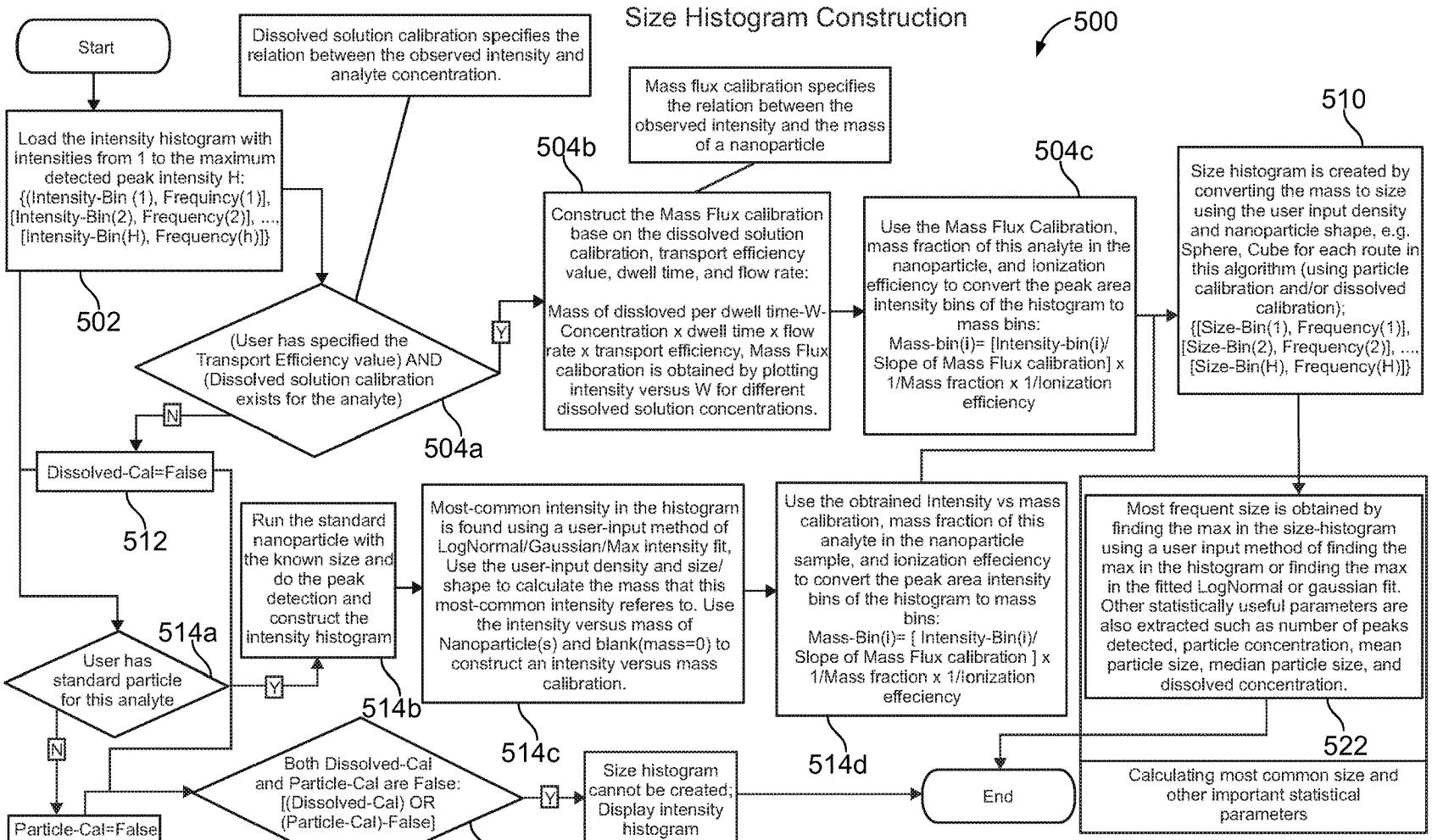
FIG. 5 is a flow chart depicting steps in the Constructing Size Histogram block and the Calculating Statistical Data block of the method of FIG. 1, according to an illustrative embodiment of the invention.

FIG. 5 is a flow chart depicting steps in the Constructing Size Histogram block and the Calculating Statistical Data block of the method of FIG. 1, according to the illustrative embodiment.

The intensity histogram constructed using the Peak Area Determination Method 400 is used to construct a two-dimensional array comprising the whole-number rounded intensities from one to the maximum detected peak intensity in the first dimension, and the corresponding frequency of each intensity in the second dimension (502). These whole-number rounded intensities are referred to as bins and all whole-number rounded intensities will correspond to a particular bin. The number of whole-number rounded intensities assigned to a bin is defined as the frequency for that particular bin.

To convert intensity to mass, and then size, Dissolved solution calibration method 504 may be used if the transport efficiency value has been specified and a dissolved solution calibration for the analyte exists (504*a*). A mass flux calibration is constructed based on the dissolved solution calibration, transport efficiency value, dwell time, and flow rate of the analysis (504*b*). The mass of dissolved analyte per dwell time is calculated by W=concentration*dwell time*flow rate*transport efficiency. The mass flux calibration is thus obtained by plotting intensity versus W for different dissolved solution concentrations. In some implementations, the dissolved solution calibration specifies the relation between the observed intensity and analyte concentration. In certain implementations, the mass flux calibration specifies the relation between the observed intensity and the mass of a nanoparticle.

The mass flux calibration, mass fraction of analyte in the nanoparticle, and ionization efficiency are used to convert the peak area intensity of the histogram to mass, wherein Mass-Bin=[Intensity-Bin/Slope of Mass Flux calibration]*[1/Mass Fraction]*[1/Ionization efficiency] (504*c*).

Alternatively, to convert intensity to mass, and then size, standard particle method 514 may be used if a standard particle for the analyte exists (514*a*). The standard nanoparticle with known size is run through analysis and a peak detection is performed, followed by construction of an intensity histogram (514*b*).

The most common intensity in the histogram is found using a method of Log Normal/Gaussian/Max intensity fit. The specified density and size/shape are used to calculate the mass that the most common intensity refers to. The intensity versus mass of the nanoparticle(s) and blank (i.e., mass=0) is used to construct an intensity versus mass calibration (514*c*).

The resulting intensity versus mass calibration, the mass fraction of the analyte in the nanoparticle sample, and the ionization efficiency are used to convert the peak area intensity of the histogram to mass (514*d*).

Once intensity has been converted to mass by steps 514*d* or 504*c*, a size histogram is created by converting the mass to size using the user input density and nanoparticle shape (e.g., solving for the size in the formula of Density=Mass/Volume, where volume is cube, sphere, etc.) (510).

The most frequent size is then obtained by finding the maximum in the size-histogram array using a user input method of finding the maximum in the histogram, or alternatively finding the max in the fitted Log Normal or Gaussian fit. Other statistically useful parameters are also extracted, such as number of peaks detected, particle concentration, mean particle size, median particle size, and dissolved concentration (522).

Figure 6A:
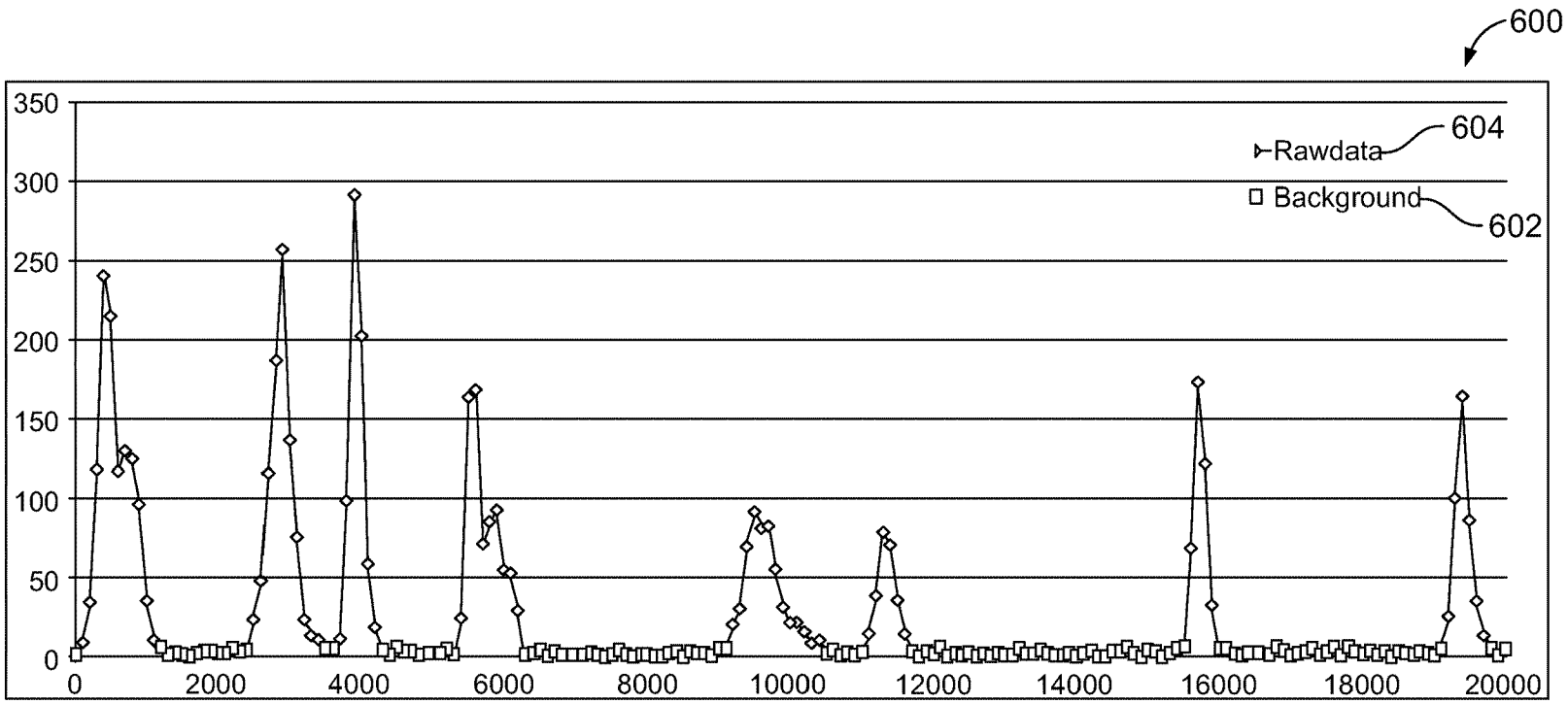
FIG. 6A is a portion of a plot showing experimental results of background determination for SP-ICP-MS data per the method of FIG. 1, according to an illustrative embodiment.

FIG. 6A is a portion of a plot showing experimental results of background determination for SP-ICP-MS data per the method of FIG. 1, according to the illustrative embodiment.

Plot 600 is a plot of the data points acquired by the SP-ICP-MS system, wherein the horizontal access depicts time, and the vertical axis depicts the magnitude of the reading. Following a background determination method such as Background Determination Method 200, those points which are less than or equal to the threshold level are identified as representing background data, and are represented by the background data indicator 602. Those data points which are not determined to be background data correspond to data that lies on a peak, and consist of those points indicated by raw data indicator 604 which are not obscured by a background data indicator.

FIG. 6B is a small portion of the data set showing iterations performed for background determination of SP-ICP-MS data per the method of FIG. 1, and result obtained, according to an illustrative embodiment.

The first column of Table 620 includes the raw data obtained by the SP-ICP-MS system. The first row of calculations in Table 640 corresponds to the raw data, and indicates the threshold approximation corresponding to the initial iteration of background determination. The data set is iteratively reduced according to the background determination method, wherein after each threshold approximation, those values which are less than or equal to the approximation are removed from the data set (e.g., the 1st iteration column of Table 620 comprises all data points of the raw data which are less than or equal to the threshold approximation calculated in the 0th iteration shown in Table 640, etc.). The data set continues to be iteratively reduced until the threshold approximation of the most recent iteration and the threshold approximation of the previous iteration are approximately equal, as indicated in the 6th iteration and 7th iteration of Table 640 (i.e., the threshold has converged).

Once the threshold has converged, the threshold (calculated using the threshold formula of the most recent data set iteration) and the background level (calculated using the average of the most recent data set iteration) are finalized (650).

Figure 7A:
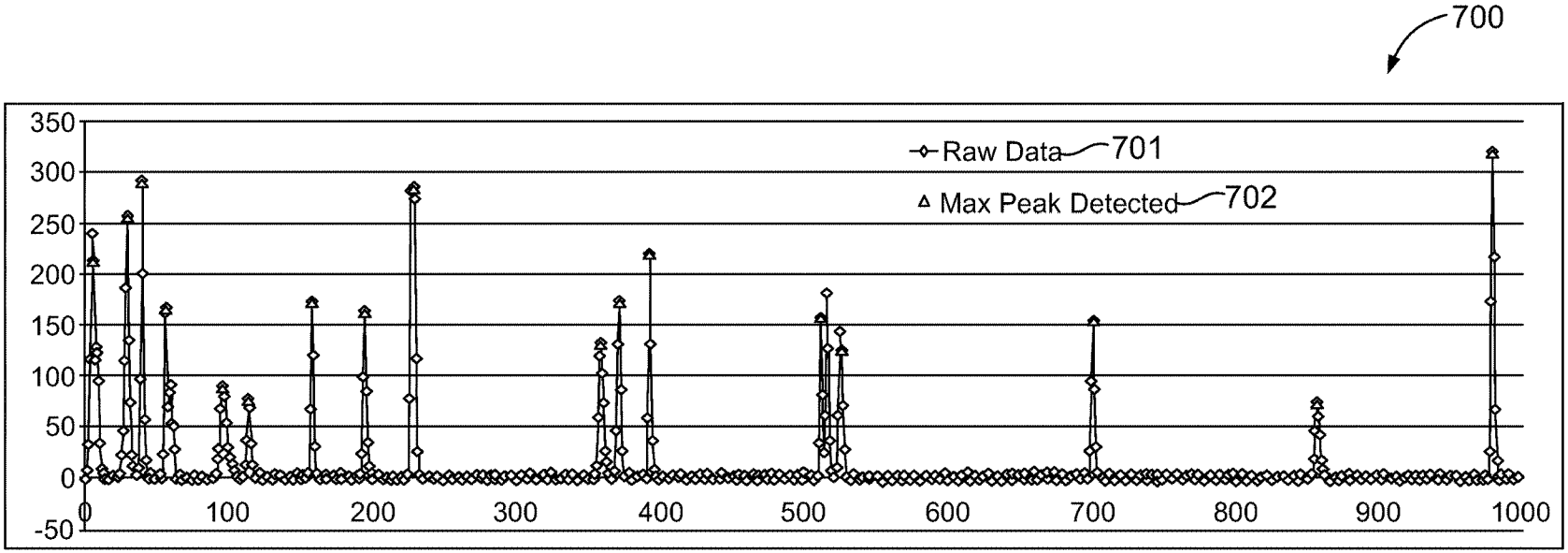
FIG. 7A is a portion of a plot showing experimental results of peak detection from SP-ICP-MS data per the method of FIG. 1, according to an illustrative embodiment.

FIG. 7A is a portion of a plot showing experimental results of peak detection from SP-ICP-MS data per the method of FIG. 1, according to an illustrative embodiment.

Plot 700 is a plot of the data points acquired by the SP-ICP-MS system, wherein the horizontal access depicts time, and the vertical axis depicts the magnitude of the reading. The data set is used with a peak detection method such as Peak Detection Method 300 to identify the location of those points which correspond to a peak in the data. The points which correspond to a particular peak are indicated by the max peak detected indicator 704. All other points, as well as the remaining points along the already identified peaks are indicated with the raw data indicator 702.

FIG. 7B is a small portion of data set showing steps performed for peak detection of SP-ICP-MS experimental data per the method of FIG. 1, according to an illustrative embodiment.

The first column of data in Table 720 shows the raw data 722 acquired by the SP-ICP-MS system. Using a peak detection method such as Peak Detection Method 300, a five point averaged data set 724 is constructed from the raw data 722, wherein each consecutive set of five points is averaged and used to construct the data set 724.

Where a point in the five point averaged data set 724 is greater than both the previous and following point in the data set, the presence of a peak is indicated within that five point range by peak position data 726. The maximum point from the raw data within the five point range identified by peak position data 726 is used to construct the maximum peaks data 728 (i.e., the maximum value identified from the five points of raw data comprising the value from the position directly indicated by the peak position data, the previous two data points, and the following two data points is used as the maximum value of the peak).

Figure 8A:
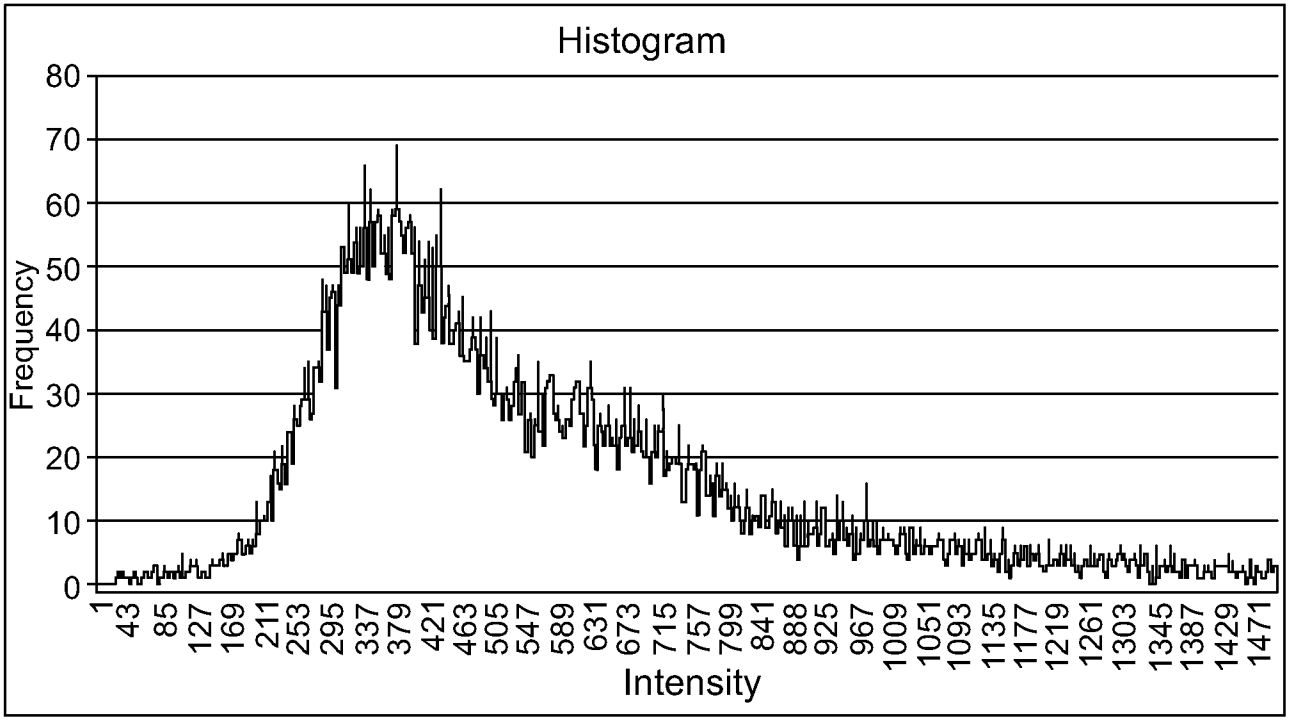
FIG. 8A is an intensity histogram computed for experimental SP-ICP-MS data per the method of FIG. 1, according to an illustrative embodiment.

FIG. 8A is an intensity histogram computed for experimental SP-ICP-MS data per the method of FIG. 1, according to an illustrative embodiment.

Plot 800 is an intensity histogram, wherein the horizontal axis depicts the whole-number rounded intensity data constructed using a peak area determination method such as Peak Area Determination Method 400, and the vertical axis depicts the frequency at which each intensity was detected in the analysis.

FIG. 8B is a small portion of data used to prepare the intensity histogram of FIG. 8A, according to an illustrative embodiment.

The first column of Table 820 comprises the peak intensity data 822 corresponding to each peak within the data set. The peak intensity data 822 is rounded to whole-number rounded intensity data 824. Table 830 shows intensity bins 832 which correspond to all whole-number values from one to the highest detected intensity, and the frequency of detection of a particular whole-number rounded intensity is defined as frequency data 834.

Figure 9A:
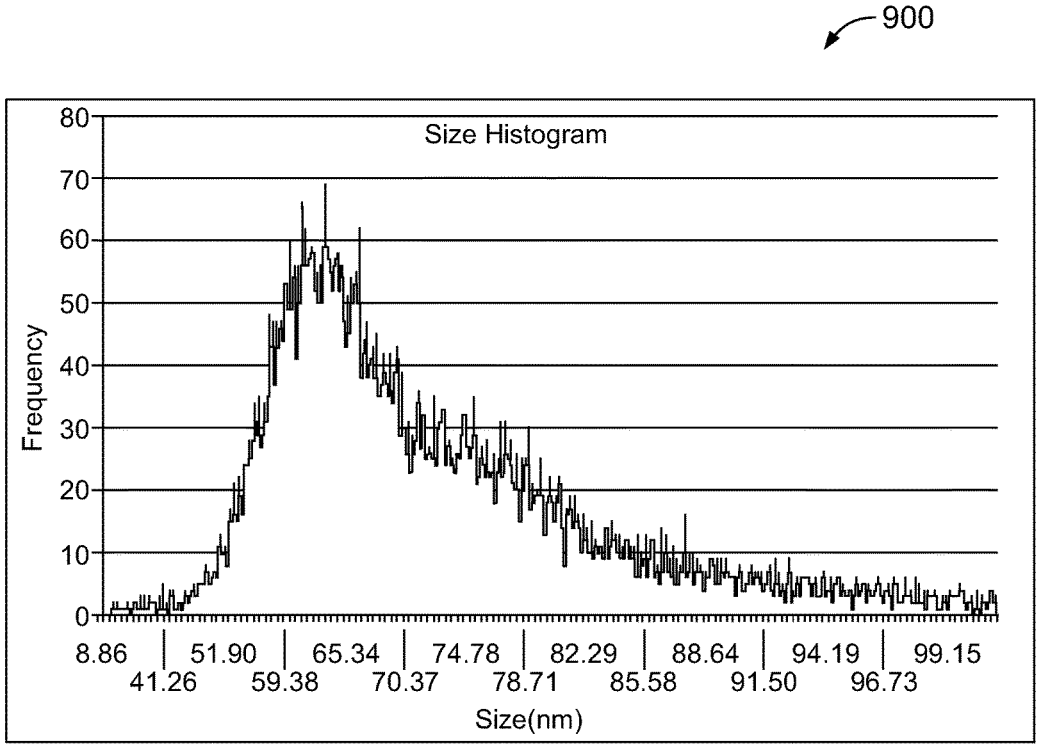
FIG. 9A is a particle size histogram computed for experimental SP-ICP-MS data per the method of FIG. 1, according to an illustrative embodiment.
Figure 9C:
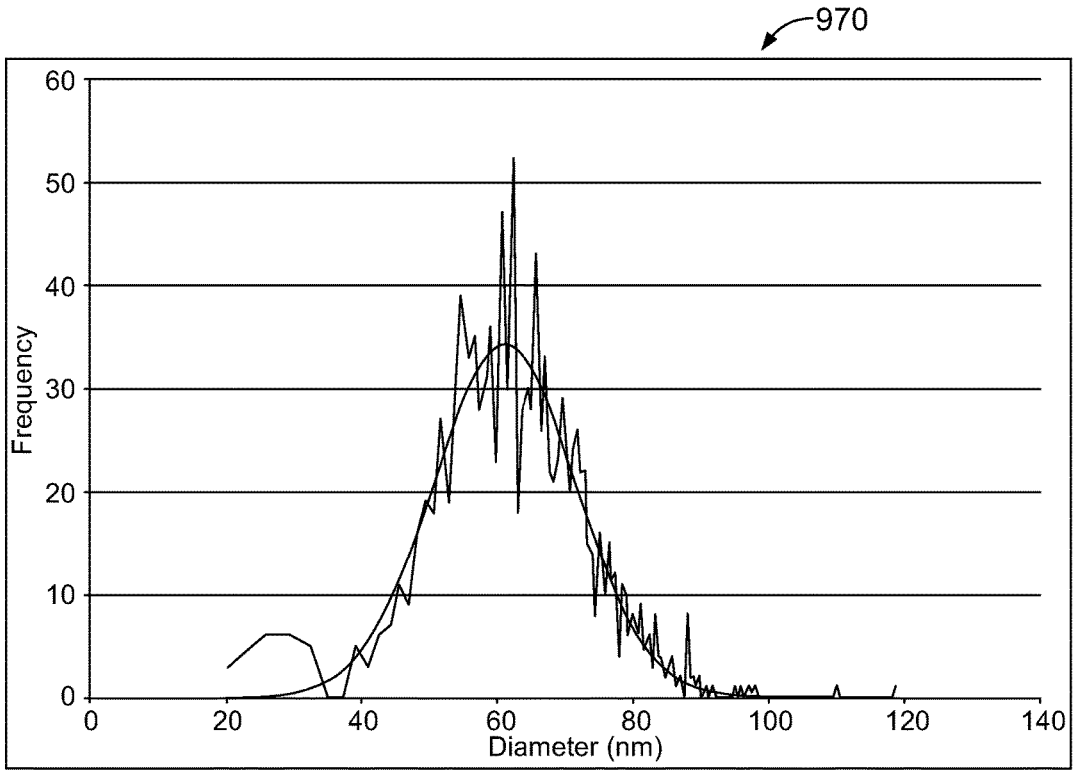
Figure 9D:
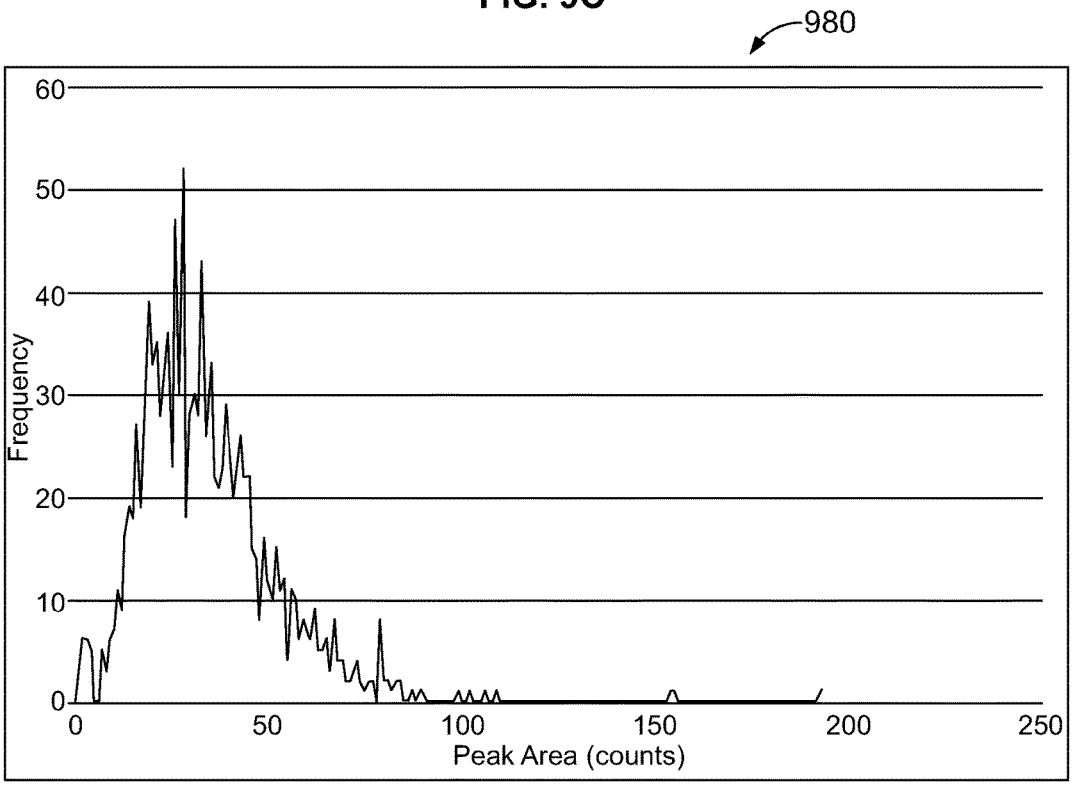
Figure 9E:
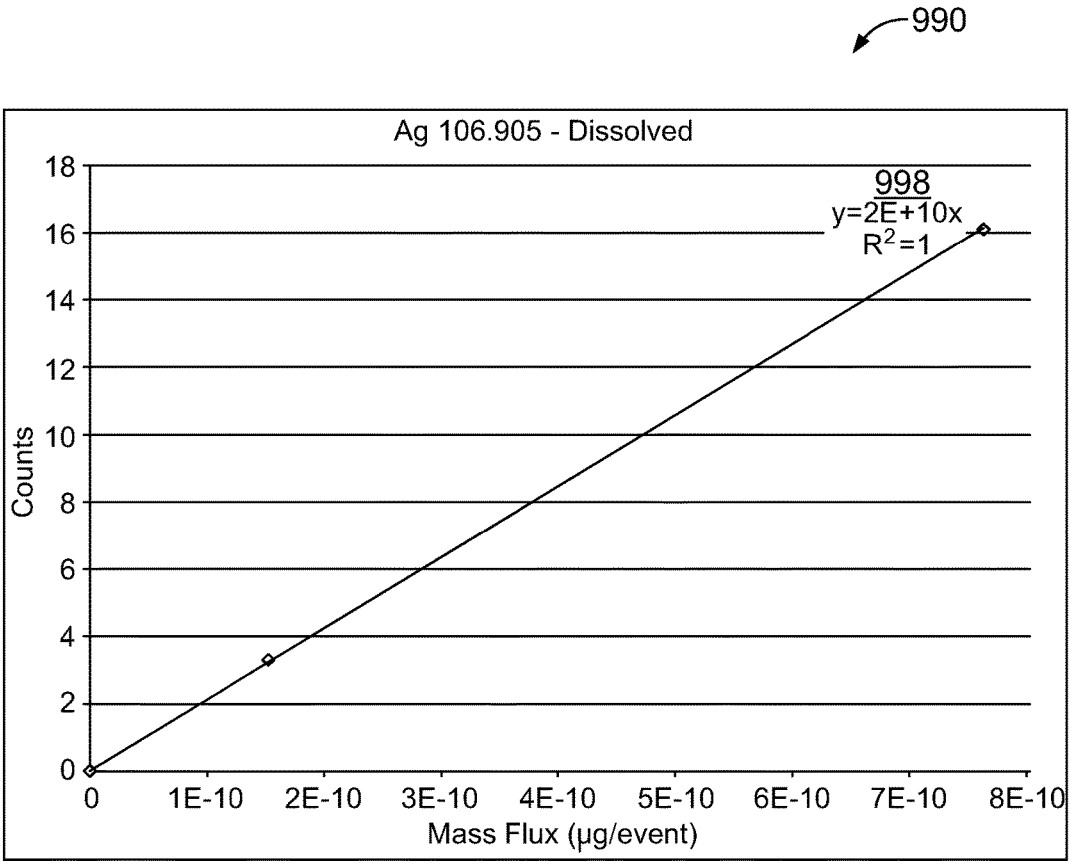

FIG. 9A is a particle size histogram computed for experimental SP-ICP-MS data per the method of FIG. 1, according to an illustrative embodiment.

Plot 900 is a particle size histogram, wherein the horizontal axis depicts the size of particles calculated from intensity bins 826 (i.e., the size calculated from the unique entries in whole-number rounded intensity data 824), and the vertical axis depicts the frequency at which each size was detected in the analysis.

FIGS. 9B, 9C, 9D, and 9E depict computations, a size histogram, an intensity histogram, and calibrations used in performing mass and size calculations and producing the size histogram for experimental SP-ICP-MS data per the method of FIG. 1, according to an illustrative embodiment.

Table 920 is an example of mass flux calibration (specifies relation between observed intensity and the mass of a nanoparticle) using the dissolved solution calibration method 504, based on dissolved solution calibration, transport efficiency value, dwell time, and flow rate as described in blocks 504, 506, 508, 510. As described in block 504*b*, Mass flux 924 is calculated by Concentration 922*dwell time 928*flow rate 930*transport efficiency 932. Mass flux calibration is then calculated by linear fit of intensity 926 versus mass flux 924 to give slope 934 and intercept 946.

Table 950 shows mass and size calculations between intensity data 952 and particle size 956. As described in block 504*c*, particle mass 954 is calculated by [intensity 952/mass flux calibration slope 934]*[1/mass fraction 942]*[1/ionization efficiency 944]. As described in block 510, particle size 956 is calculated from density 946 and particle shape (spherical) by [[6*particle mass 944/Pi]*[1/density 946]]^[⅓].

Plot 970 shows a size histogram of frequency data versus particle size, indicating the frequency at which a particular size of particle occurred in the analysis. Plot 980 shows an intensity histogram of frequency data versus intensity, indicating the frequency at which a particular intensity occurred in the analysis. Plot 990 is a plot of mass flux calibration calculated by linear fit of intensity 996 versus mass flux 994 to give mass flux calibration 998.

Figure 10:
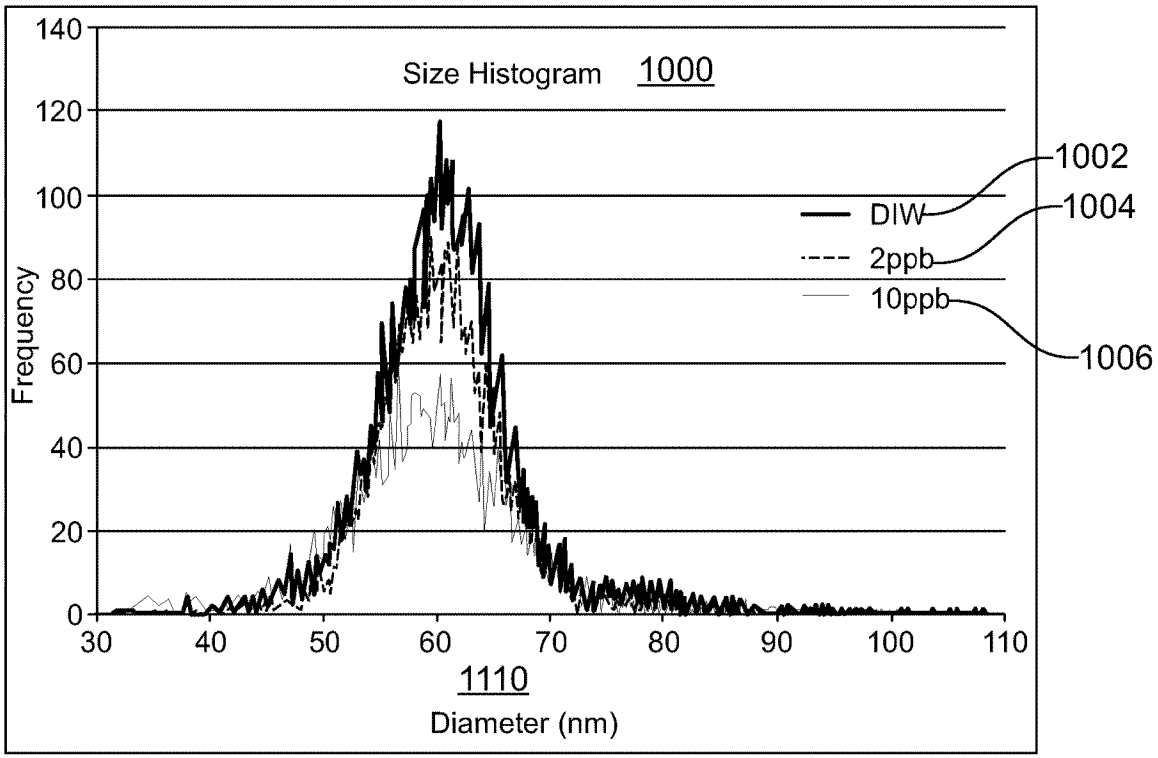
FIG. 10 shows a size histogram computed for SP-ICP-MS-run samples having known dissolved concentration to demonstrate detection of correct suspended nanoparticle size without interference from the dissolved analyte per the method of FIG. 1, according to an illustrative embodiment.

FIG. 10 shows a size histogram computed for SP-ICP-MS-run samples having known dissolved concentration to demonstrate detection of correct suspended nanoparticle size without interference from the dissolved analyte per the method of FIG. 1, according to an illustrative embodiment.

Plot 1000 shows detected size of particle contained in DIW 1020, 2 ppb 1022, and 10 ppb 1024 dissolved analyte concentration. The peak at 60 nm 1026 is clearly indicated by the size histogram constructed in accordance with the methods described herein, which corresponds to the actual measured size 1028 of the sample.

FIGS. 11A, 11B, and 11C show computations of average particle size and standard deviation for known samples from SP-ICP-MS experimental data to demonstrate accuracy and precision of the method of FIG. 1 for determining average particle size and differentiating analyte in solid particle form from dissolved analyte, according to an illustrative embodiment.

Plots 1110 and 1130 show detected sample with relatively high (13 ppb) and low (0.44) dissolved analyte concentration. In both examples, relatively low standard deviations 1112 and 1132 indicate high precision throughout the collected data. Tables 1150 and 1170 show further consistency between sample readings and dissolved standard solution.

Figure 12:
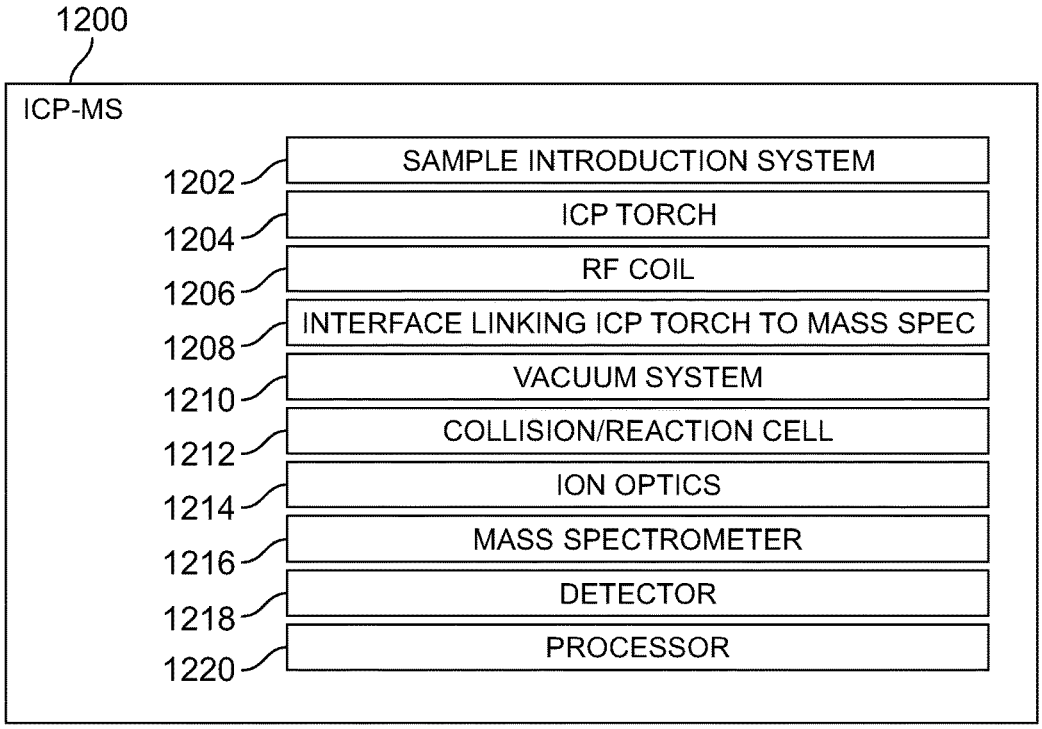
FIG. 12 is a schematic diagram of components of an ICP-MS system, according to an illustrative embodiment.

FIG. 12 is a schematic diagram of components of an ICP-MS system, according to an illustrative embodiment.

The ICP-MS system 1200 is an instrument for performing trace metal analysis on a sample. Sample Introduction System 1202 is composed of a nebulizer and spray chamber which introduce the sample into an argon plasma as aerosol droplets. Using RF Coil 1206, ICP Torch 1204 generates the argon plasma that serves as the ion source, which dries the aerosol, dissociates the molecules, then removes an electron from the components, thereby forming singly-charged ions. Interface 1208 links the atmospheric pressure ICP ion source to high vacuum mass spectrometer 1216. Mass spectrometer 1216 acts as a mass filter to sort ions by their mass-to-charge ratio (m/z). Vacuum system 1210 creates the vacuum for ion optics 1214, which guides the desired ions into a quadrupole while assuring that neutral species and photons are discarded from the ion beam. Collision/reaction cell 1212 precedes the mass spectrometer and is used to remove interferences that can degrade achievable detection limits. Detector 1218 counts individual ions exiting the quadrupole. Processor 1220 is used to control aspects of instrument control and data handling for use in obtaining final concentration results.

Figure 13:
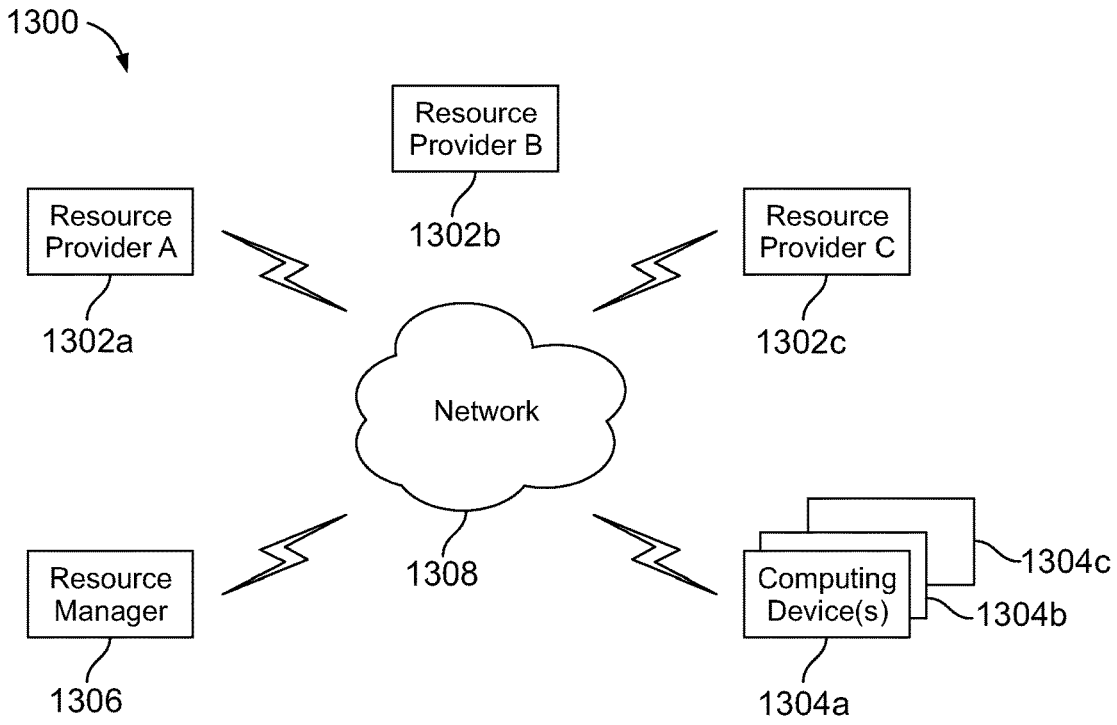
FIG. 13 is a block diagram of an example network environment for use in the methods and systems for analysis of spectrometry data, according to an illustrative embodiment.

FIG. 13 shows an illustrative network environment 1300 for use in the methods and systems for analysis of spectrometry data corresponding to particles of a sample, as described herein. In brief overview, referring now to FIG. 13, a block diagram of an exemplary cloud computing environment 1300 is shown and described. The cloud computing environment 1300 may include one or more resource providers 1302*a*, 1302*b*, 1302*c* (collectively, 1302). Each resource provider 1302 may include computing resources. In some implementations, computing resources may include any hardware and/or software used to process data. For example, computing resources may include hardware and/or software capable of executing algorithms, computer programs, and/or computer applications. In some implementations, exemplary computing resources may include application servers and/or databases with storage and retrieval capabilities. Each resource provider 1302 may be connected to any other resource provider 1302 in the cloud computing environment 1300. In some implementations, the resource providers 1302 may be connected over a computer network 1308. Each resource provider 1302 may be connected to one or more computing device 1304*a*, 1304*b*, 1304*c* (collectively, 1304), over the computer network 1308.

The cloud computing environment 1300 may include a resource manager 1306. The resource manager 1306 may be connected to the resource providers 1302 and the computing devices 1304 over the computer network 1308. In some implementations, the resource manager 1306 may facilitate the provision of computing resources by one or more resource providers 1302 to one or more computing devices 1304. The resource manager 1306 may receive a request for a computing resource from a particular computing device 1304. The resource manager 1306 may identify one or more resource providers 1302 capable of providing the computing resource requested by the computing device 1304. The resource manager 1306 may select a resource provider 1302 to provide the computing resource. The resource manager 1306 may facilitate a connection between the resource provider 1302 and a particular computing device 1304. In some implementations, the resource manager 1306 may establish a connection between a particular resource provider 1302 and a particular computing device 1304. In some implementations, the resource manager 1306 may redirect a particular computing device 1304 to a particular resource provider 1302 with the requested computing resource.

Figure 14:
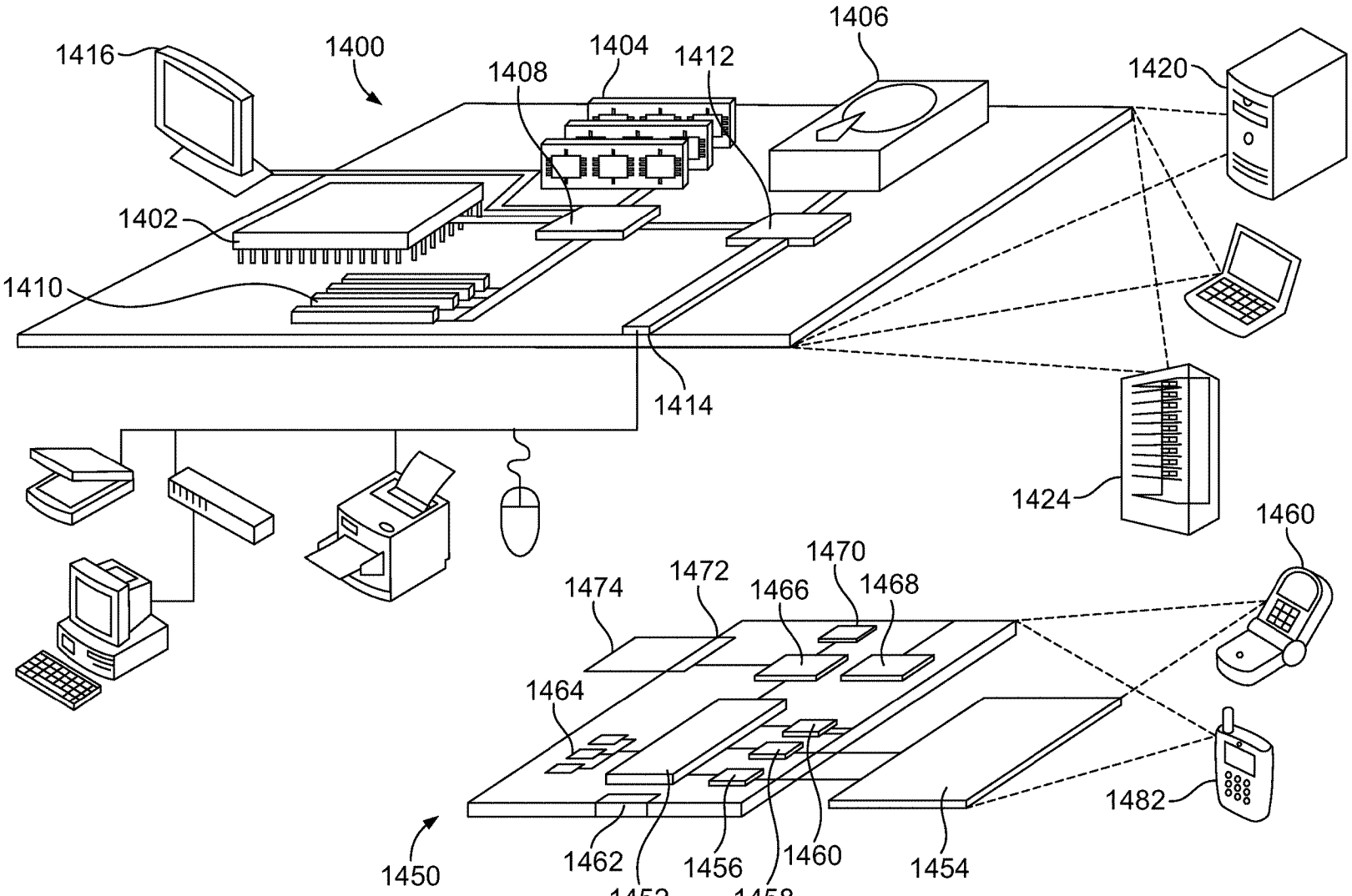
FIG. 14 is a block diagram of an example computing device and an example mobile computing device, for use in illustrative embodiments of the invention.

FIG. 14 shows an example of a computing device 1400 and a mobile computing device 1450 that can be used in the methods and systems described in this disclosure. The computing device 1400 is intended to represent various forms of digital computers, such as laptops, desktops, workstations, personal digital assistants, servers, blade servers, mainframes, and other appropriate computers. The mobile computing device 1450 is intended to represent various forms of mobile devices, such as personal digital assistants, cellular telephones, smart-phones, and other similar computing devices. The components shown here, their connections and relationships, and their functions, are meant to be examples only, and are not meant to be limiting.

The computing device 1400 includes a processor 1402, a memory 1404, a storage device 1406, a high-speed interface 1408 connecting to the memory 1404 and multiple high-speed expansion ports 1410, and a low-speed interface 1412 connecting to a low-speed expansion port 1414 and the storage device 1406. Each of the processor 1402, the memory 1404, the storage device 1406, the high-speed interface 1408, the high-speed expansion ports 1410, and the low-speed interface 1412, are interconnected using various busses, and may be mounted on a common motherboard or in other manners as appropriate. The processor 1402 can process instructions for execution within the computing device 1400, including instructions stored in the memory 1404 or on the storage device 1406 to display graphical information for a GUI on an external input/output device, such as a display 1416 coupled to the high-speed interface 1408. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 1404 stores information within the computing device 1400. In some implementations, the memory 1404 is a volatile memory unit or units. In some implementations, the memory 1404 is a non-volatile memory unit or units. The memory 1404 may also be another form of computer-readable medium, such as a magnetic or optical disk.

The storage device 1406 is capable of providing mass storage for the computing device 1400. In some implementations, the storage device 1406 may be or contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 1402), perform one or more methods, such as those described above. The instructions can also be stored by one or more storage devices such as computer- or machine-readable mediums (for example, the memory 1404, the storage device 1406, or memory on the processor 1402).

The high-speed interface 1408 manages bandwidth-intensive operations for the computing device 1400, while the low-speed interface 1412 manages lower bandwidth-intensive operations. Such allocation of functions is an example only. In some implementations, the high-speed interface 1408 is coupled to the memory 1404, the display 1416 (e.g., through a graphics processor or accelerator), and to the high-speed expansion ports 1410, which may accept various expansion cards (not shown). In the implementation, the low-speed interface 1412 is coupled to the storage device 1406 and the low-speed expansion port 1414. The low-speed expansion port 1414, which may include various communication ports (e.g., USB, Bluetooth®, Ethernet, wireless Ethernet) may be coupled to one or more input/output devices, such as a keyboard, a pointing device, a scanner, or a networking device such as a switch or router, e.g., through a network adapter.

The computing device 1400 may be implemented in a number of different forms, as shown in the figure. For example, it may be implemented as a standard server 1420, or multiple times in a group of such servers. In addition, it may be implemented in a personal computer such as a laptop computer 1422. It may also be implemented as part of a rack server system 1424. Alternatively, components from the computing device 1400 may be combined with other components in a mobile device (not shown), such as a mobile computing device 1450. Each of such devices may contain one or more of the computing device 1400 and the mobile computing device 1450, and an entire system may be made up of multiple computing devices communicating with each other.

The mobile computing device 1450 includes a processor 1452, a memory 1464, an input/output device such as a display 1454, a communication interface 1466, and a transceiver 1468, among other components. The mobile computing device 1450 may also be provided with a storage device, such as a micro-drive or other device, to provide additional storage. Each of the processor 1452, the memory 1464, the display 1454, the communication interface 1466, and the transceiver 1468, are interconnected using various buses, and several of the components may be mounted on a common motherboard or in other manners as appropriate.

The processor 1452 can execute instructions within the mobile computing device 1450, including instructions stored in the memory 1464. The processor 1452 may be implemented as a chipset of chips that include separate and multiple analog and digital processors. The processor 1452 may provide, for example, for coordination of the other components of the mobile computing device 1450, such as control of user interfaces, applications run by the mobile computing device 1450, and wireless communication by the mobile computing device 1450.

The processor 1452 may communicate with a user through a control interface 1458 and a display interface 1456 coupled to the display 1454. The display 1454 may be, for example, a TFT (Thin-Film-Transistor Liquid Crystal Display) display or an OLED (Organic Light Emitting Diode) display, or other appropriate display technology. The display interface 1456 may comprise appropriate circuitry for driving the display 1454 to present graphical and other information to a user. The control interface 1458 may receive commands from a user and convert them for submission to the processor 1452. In addition, an external interface 1462 may provide communication with the processor 1452, so as to enable near area communication of the mobile computing device 1450 with other devices. The external interface 1462 may provide, for example, for wired communication in some implementations, or for wireless communication in other implementations, and multiple interfaces may also be used.

The memory 1464 stores information within the mobile computing device 1450. The memory 1464 can be implemented as one or more of a computer-readable medium or media, a volatile memory unit or units, or a non-volatile memory unit or units. An expansion memory 1474 may also be provided and connected to the mobile computing device 1450 through an expansion interface 1472, which may include, for example, a SIMM (Single In Line Memory Module) card interface. The expansion memory 1474 may provide extra storage space for the mobile computing device 1450, or may also store applications or other information for the mobile computing device 1450. Specifically, the expansion memory 1474 may include instructions to carry out or supplement the processes described above, and may include secure information also. Thus, for example, the expansion memory 1474 may be provided as a security module for the mobile computing device 1450, and may be programmed with instructions that permit secure use of the mobile computing device 1450. In addition, secure applications may be provided via the SIMM cards, along with additional information, such as placing identifying information on the SIMM card in a non-hackable manner.

The memory may include, for example, flash memory and/or NVRAM memory (non-volatile random access memory), as discussed below. In some implementations, instructions are stored in an information carrier and, when executed by one or more processing devices (for example, processor 1452), perform one or more methods, such as those described above. The instructions can also be stored by one or more storage devices, such as one or more computer- or machine-readable mediums (for example, the memory 1464, the expansion memory 1474, or memory on the processor 1452). In some implementations, the instructions can be received in a propagated signal, for example, over the transceiver 1468 or the external interface 1462.

The mobile computing device 1450 may communicate wirelessly through the communication interface 1466, which may include digital signal processing circuitry where necessary. The communication interface 1466 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 1468 using a radio-frequency. In addition, short-range communication may occur, such as using a Bluetooth®, Wi-Fi™, or other such transceiver (not shown). In addition, a GPS (Global Positioning System) receiver module 1470 may provide additional navigation- and location-related wireless data to the mobile computing device 1450, which may be used as appropriate by applications running on the mobile computing device 1450.

The mobile computing device 1450 may also communicate audibly using an audio codec 1460, which may receive spoken information from a user and convert it to usable digital information. The audio codec 1460 may likewise generate audible sound for a user, such as through a speaker, e.g., in a handset of the mobile computing device 1450. Such sound may include sound from voice telephone calls, may include recorded sound (e.g., voice messages, music files, etc.) and may also include sound generated by applications operating on the mobile computing device 1450.

The mobile computing device 1450 may be implemented in a number of different forms, as shown in the figure. For example, it may be implemented as a cellular telephone 1480. It may also be implemented as part of a smart-phone 1482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method for automated analysis of spectrometry data the method comprising:

(a) accessing, by a processor of a computing device, a sequence of pulse count values acquired by a spectrometer to produce, for each of at least one given peak corresponding to particles comprising an analyte and being present in a sample, pulse count values being greater than a threshold background intensity value;

(b) determining, by the processor, from a first array of the pulse count values, a threshold for identifying pulse count values as corresponding to a peak signal, and adjusting the threshold based on remaining pulse count values following each of a series of iterations, with a given subsequent iteration including pulse count values not identified as corresponding to a peak in a preceding iteration, wherein a final background threshold is determined upon convergence of the threshold within acceptable tolerance;

(c) building, by the processor, from the first array of the pulse count values, a smoothed data array comprising smoothed values and identifying, as identified peaks, a subset of the smoothed values that are larger than both subsequent and preceding smoothed values of the smoothed data array and also larger than the final background threshold; and (d) automatically determining, by the processor, based on the identified peaks, at least one of:

(A) a particle mass distribution and/or particle size distribution for the particles in the sample; and (B) statistical data for the particles in the sample.

2. The method of claim 1, wherein the spectrometer is an inductively coupled plasma mass spectrometer (ICP-MS).

3. The method of claim 1, wherein the particles in the sample are nanoparticles.

4. The method of claim 1, wherein the particles in the sample are microparticles or cells.

5. The method of claim 1, wherein the sequence of pulse count values contain an average of no less than 2 pulse count values per peak in the sample.

6. The method of claim 1, wherein the threshold for at least one iteration in step (b) adjusted based on an average of remaining values in the array plus a multiple of the standard deviation.

7. The method of claim 1, wherein the smoothed data array is an x-point averaged data array and wherein step (c) further comprises storing positions of the identified peaks in a peak position array and repeating step (c) with one or more additional x-values and converging on an acceptable x-value.

8. The method of claim 1, wherein the smoothed data array is an x-point averaged data array and step (c) comprises building the x-point averaged data array to produce the smoothed data array, where x is a predetermined integer, and wherein step (c) further comprises identifying an average number of pulse count values per identified peak in the first array of pulse count values using the x-point averaged data array, then building, from the first array of the pulse count values, an x'-point averaged data array, identifying as peaks the values of the x'-point averaged data array that are larger than both subsequent and preceding averaged values and larger than the final background threshold, where x' is determined from the average number of pulse count values per identified peak using the x-point averaged data array, and wherein step (d) comprises identifying a peak area intensity corresponding to each of the peaks identified using the x'-point averaged data array.

9. The method of claim 1, wherein step (d) comprises:

automatically determining whether a transport efficiency value for the sample has been specified and whether a dissolved solution calibration exists for the analyte; and responsive to a determination that both the transport efficiency value for the sample has been specified and the dissolved solution calibration exists for the analyte, constructing, by the processor, a mass flux calibration for the sample using: the transport efficiency value for the sample, the dissolved solution calibration for the analyte, and a dwell time and a flow rate for the sample in the spectrometer.

10. The method of claim 9, wherein step (d) further comprises:

determining, for each of the identified peaks in step (c), a peak area intensity, thereby determining a histogram of peak area intensities for the sample; and computing a particle mass histogram for the sample using: (i) the histogram of peak area intensities for the sample, (ii) the mass flux calibration for the sample, (iii) a mass fraction of the particles that is the analyte, (iv) an ionization efficiency, (v) a determined or known shape of the particles, and (vi) a determined or known density of the particles.

11. The method of claim 1, wherein dwell time for each pulse count is no greater than 10 milliseconds.

12. The method of claim 1, wherein a dwell time for each pulse count value is from 10 microseconds to 500 microseconds.

13. The method of claim 1, wherein settling time for the sample is no greater than 200 microseconds.

14. The method of claim 1, wherein the analyte comprises at least one metallic element.

15. The method of claim 1, wherein the analyte comprises at least one element selected from the group consisting of Li, Be, B, Na, Mg, Al, Si, P, S, Cl, Ar, K, Ca, Sc, Ti, V, Cr, Mn, Fe, Co, Ni, Cu, Zn, Ga, Ge, As, Se, Br, Kr, Rb, Sr, Y, Zr, Nb, Mo, Tc, Ru, Rh, Pd, Ag, Cd, In, Sn, Sb, Te, I, Xe, Cs, Ba, La, Hf, Ta, W, Re, Os, Ir, Pt, Au, Hg, Tl, Pb, Bi, Ce, Pr, Nd, Sm, Eu, Gd, Tb, Dy, Ho, Er, Tm, Yb, Lu, Th, Pa, and U.

16. The method of claim 1, wherein particles in the sample all have substantially the same composition.

17. The method of claim 1, further comprising acquiring the sequence of pulse count values using the spectrometer.

18. The method of claim 1, wherein the pulse count values acquired by the spectrometer are filtered and/or normalized by the processor before determining the threshold from the first array of the pulse count values in step (b).

19. The method of claim 1, wherein step (d) comprises:

for each of the identified peaks in step (c), determining, by the processor, a peak area intensity corresponding to the identified peak, wherein determining the peak area intensity corresponding to the identified peak comprises:

determining, within the first array of pulse count values, a peak point corresponding to the identified peak;

initially populating a summation variable with the pulse count value of the peak point, less the final background threshold determined in step (b);

iteratively adding to the value of the summation variable, for each point to the right of the peak point until a point is determined to be less than or equal to the final background threshold determined in step (b), a pulse count value of the point to the right of the peak point less the final background threshold determined in step (b); and iteratively adding to the value of the summation variable, for each point to the left of the peak point until either (i) a point is determined to be less than or equal to the final background threshold determined in step (b) or (ii) a beginning of the first array of pulse count values is determined to have been reached, a pulse count value of the point to the left of the peak point less the final background threshold determined in step (b), the method further comprising using the peak area intensity determined in step (d) to determine at least one of (A) and (B).

20. The method of claim 1, wherein the statistical data for the particles in the sample comprises one or more of (i) to (vi) as follows:

(i) a particle mass histogram for the particles in the sample;

(ii) a particle size histogram for the particles in the sample;

(iii) a mean particle size for the particles in the sample;

(iv) a median particle size for the particles in the sample;

(v) a mode particle size for the particles in the sample; and (vi) a measure of width of a particle size distribution for the particles in the sample.

21. The method of claim 1, wherein step (d) further comprises automatically determining, based on the identified peaks, at least one of:

(i) a particle concentration for the sample; and (ii) a dissolved analyte concentration for the sample.

22. The method of claim 1, further comprising determining, based on the identified peaks, a number of peaks detected for the sample.

23. The method of claim 1, wherein the smoothed values are averages of consecutive values of the first array of the pulse count values.

24. A system for automated analysis of spectrometry data, the system comprising:

a processor; and a memory, wherein the memory comprises instructions that, when executed by the processor, cause the processor to:

(a) access a sequence of pulse count values acquired by a spectrometer to produce, for each of at least one given peak corresponding to particles comprising an analyte and being present in a sample, pulse count values each being greater than a threshold background intensity value;

(b) determine, from a first array of the pulse count values, a threshold for identifying pulse count values as corresponding to a peak signal, and adjust the threshold based on remaining pulse count values following each of a series of iterations, with a given subsequent iteration including pulse count values not identified as corresponding to a peak in a preceding iteration, wherein a final background threshold is determined upon convergence of the threshold within acceptable tolerance;

(c) build, from the first array of the pulse count values, a smoothed data array comprising smoothed values and identifying, as identified peaks, a subset of the smoothed values that are larger than both subsequent and preceding smoothed values of the smoothed data array and also larger than the final background threshold; and (d) automatically determine, based on the identified peaks, at least one of:

(A) a particle mass distribution and/or particle size distribution for the particles in the sample; and (B) statistical data for the particles in the sample.

25. The system of claim 24, further comprising the spectrometer for acquiring the sequence of pulse count values, wherein the spectrometer is an inductively coupled plasma mass spectrometer (ICP-MS).

26. The system of claim 25, wherein the ICP-MS comprises:

a sample introduction system;

an ICP torch and RF coil for generating an argon plasma that serves as an atmospheric pressure ion source;

an interface that links the atmospheric pressure ion source to a high vacuum mass spectrometer;

a vacuum system that provides high vacuum for ion optics, a quadrupole, and a detector;

a collision/reaction cell that is configured to remove interferences that can degrade achievable detection limits;

wherein the ion optics guide desired ions into the quadrupole while assuring that neutral species and photons are discarded wherein the ICP-MS is configured to sort ions by their mass-to-charge ratio (m/z);

the ICP-MS further comprising:

a detector that counts individual ions exiting the quadrupole; and a data handling and system controller that controls aspects of instrument control and data acquisition and processing for use in obtaining final concentration results, wherein the processor is part of the data handling and system controller.

* * * * *